US012433458B2

(12) United States Patent
Niedzwecki et al.

(10) Patent No.: US 12,433,458 B2
(45) Date of Patent: Oct. 7, 2025

(54) UPRIGHT SURFACE TREATMENT APPARATUS HAVING REMOVABLE POD

(71) Applicant: SharkNinja Operating, LLC, Needham, MA (US)

(72) Inventors: Scott B Niedzwecki, East Walpole, MA (US); Andre D. Brown, Natick, MA (US); Mingshun (Aaron) Su, Suzhou (CN); Robert Yang, Suzhou (CN); Lee M. Cottrell, Newton, MA (US); Patrick Cleary, Allston, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/649,361

(22) Filed: Apr. 29, 2024

(65) Prior Publication Data

US 2024/0349959 A1 Oct. 24, 2024

Related U.S. Application Data

(63) Continuation of application No. 17/878,693, filed on Aug. 1, 2022, now Pat. No. 11,998,157, which is a (Continued)

(51) Int. Cl.

| | |
|---|---|
| ***A47L 5/22*** | (2006.01) |
| ***A47L 5/36*** | (2006.01) |
| ***A47L 9/00*** | (2006.01) |

(52) U.S. Cl.

CPC ..... *A47L 5/225* (2013.01); *A47L 5/36* (2013.01); *A47L 9/0018* (2013.01)

(58) Field of Classification Search

CPC ..... A47L 5/225; A47L 5/36; A47L 9/0018; A47L 5/28; A47L 9/0054; A47L 9/1427; A47L 9/246; A47L 9/248; A47L 9/2884

See application file for complete search history.

(56) References Cited

U.S. PATENT DOCUMENTS

| | | | |
|---|---|---|---|
| 5,389,004 | A | 2/1995 | Gray et al. |
| 6,530,118 | B2 | 3/2003 | Oh |

(Continued)

FOREIGN PATENT DOCUMENTS

| | | |
|---|---|---|
| CN | 2549882 | 5/2003 |
| CN | 1463656 | 12/2003 |

(Continued)

OTHER PUBLICATIONS

PCT Search Report and Written Opinion mailed Apr. 26, 2019, received in corresponding PCT Application No. PCT/US19/17030, 9 pgs.

(Continued)

*Primary Examiner* — Marc Carlson

(74) *Attorney, Agent, or Firm* — Grossman Tucker Perreault & Pfleger, PLLC

(57) ABSTRACT

A reconfigurable surface treatment apparatus may include a wand and a pod removably coupled to the wand. The wand may have a first distal end that is configured to couple to a surface cleaning head and a second distal end that is configured to couple to a handle. The pod may include a suction motor assembly cavity, a battery cavity, and a dust cup cavity. The suction motor assembly cavity and the battery cavity may be disposed on opposing sides of a vertical plane, wherein the vertical plane extends along a central longitudinal axis of the pod. The dust cup cavity may be disposed between the suction motor assembly cavity and the battery cavity such that at least a portion of the dust cup cavity is disposed on each side of the vertical plane.

20 Claims, 20 Drawing Sheets

Related U.S. Application Data continuation of application No. 16/528,212, filed on Jul. 31, 2019, now Pat. No. 11,399,675, which is a continuation-in-part of application No. 16/270,078, filed on Feb. 7, 2019, now Pat. No. 11,617,482.

(60) Provisional application No. 62/712,634, filed on Jul. 31, 2018.

(56) References Cited

U.S. PATENT DOCUMENTS

| | | | | |
|---|---|---|---|---|
| 7,377,007 | B2 | 5/2008 | Best | |
| 8,826,490 | B1 | 9/2014 | Giarmo | |
| 8,943,647 | B1 | 2/2015 | Henderson | |
| D740,506 | S | 10/2015 | Yoon | |
| D743,649 | S | 11/2015 | Yoon et al. | |
| D745,232 | S | 12/2015 | Yoon et al. | |
| 10,638,901 | B2 | 5/2020 | Yang et al. | |
| 10,986,972 | B2 * | 4/2021 | Jenson | A47L 11/4005 |
| 2002/0101075 | A1 | 8/2002 | Park et al. | |
| 2004/0223803 | A1 | 11/2004 | Fahy et al. | |
| 2008/0031678 | A1 | 2/2008 | Gansebom et al. | |
| 2012/0042471 | A1 | 2/2012 | Spiggle | |
| 2013/0058635 | A1 | 3/2013 | Vrdoljak | |
| 2013/0152337 | A1 | 6/2013 | Thorne | |
| 2013/0255029 | A1 | 10/2013 | Wolfe, Jr. et al. | |
| 2014/0150201 | A1 | 6/2014 | McGee et al. | |
| 2014/0338146 | A1 | 11/2014 | Lee et al. | |
| 2014/0338148 | A1 | 11/2014 | Lee et al. | |
| 2015/0013102 | A1 | 1/2015 | Bilger | |
| 2015/0040340 | A1 | 2/2015 | Bilger et al. | |
| 2015/0135474 | A1 | 5/2015 | Gidwell | |
| 2015/0297054 | A1 | 10/2015 | Weeks et al. | |
| 2015/0351596 | A1 | 12/2015 | Thorne | |
| 2016/0128530 | A1 | 5/2016 | Thorne et al. | |
| 2016/0174793 | A1 | 6/2016 | Burke et al. | |
| 2016/0208981 | A1 | 7/2016 | Kaesemeyer | |
| 2016/0220080 | A1 | 8/2016 | Thorne | |
| 2016/0220081 | A1 | 8/2016 | Xu et al. | |
| 2016/0220082 | A1 | 8/2016 | Thorne et al. | |
| 2016/0235267 | A1 | 8/2016 | Han et al. | |
| 2016/0270614 | A1 | 9/2016 | Kawamura et al. | |
| 2016/0270615 | A1 | 9/2016 | Kawamura et al. | |
| 2016/0324388 | A1 | 11/2016 | Vrdoljak et al. | |
| 2016/0374533 | A1 | 12/2016 | Innes et al. | |
| 2017/0042319 | A1 | 2/2017 | Conrad et al. | |
| 2017/0112343 | A1 | 4/2017 | Innes et al. | |
| 2017/0127896 | A1 | 5/2017 | Carter et al. | |
| 2017/0144810 | A1 | 5/2017 | Birdsell | |
| 2017/0196425 | A1 * | 7/2017 | Brown | A47L 9/1641 |
| 2017/0209014 | A1 * | 7/2017 | Stickney | A47L 5/28 |
| 2017/0215667 | A1 | 8/2017 | Thorne et al. | |
| 2017/0340182 | A1 | 11/2017 | Caruso | |
| 2017/0347848 | A1 | 12/2017 | Carter et al. | |
| 2018/0035854 | A1 | 2/2018 | Thorne | |
| 2018/0055313 | A1 * | 3/2018 | Yang | A47L 9/0427 |
| 2018/0064301 | A1 | 3/2018 | Cottrell et al. | |
| 2018/0068815 | A1 | 3/2018 | Cottrell | |
| 2018/0070785 | A1 | 3/2018 | Udy et al. | |
| 2018/0132683 | A1 | 5/2018 | Walker | |
| 2018/0177368 | A1 | 6/2018 | Acker et al. | |
| 2018/0255991 | A1 | 9/2018 | Der Marderosian et al. | |
| 2018/0296046 | A1 | 10/2018 | Thorne et al. | |
| 2018/0306432 | A1 | 10/2018 | Ognjen et al. | |
| 2018/0325252 | A1 | 11/2018 | Hopke et al. | |
| 2018/0338654 | A1 | 11/2018 | Kelsey | |
| 2018/0338656 | A1 | 11/2018 | Carter et al. | |
| 2019/0038098 | A1 | 2/2019 | Thorne et al. | |
| 2019/0059668 | A1 | 2/2019 | Thorne et al. | |
| 2019/0069740 | A1 | 3/2019 | Thorne et al. | |
| 2019/0069744 | A1 | 3/2019 | Liggett et al. | |
| 2019/0090701 | A1 | 3/2019 | Tonderys et al. | |
| 2019/0090705 | A1 | 3/2019 | Thorne et al. | |
| 2019/0191947 | A1 | 6/2019 | Freese et al. | |
| 2019/0193120 | A1 | 6/2019 | Brown et al. | |
| 2019/0246853 | A1 | 8/2019 | Sardar et al. | |
| 2019/0274500 | A1 | 9/2019 | Thorne et al. | |
| 2019/0274501 | A1 | 9/2019 | Antonisami et al. | |
| 2019/0302793 | A1 | 10/2019 | Leech et al. | |
| 2019/0320865 | A1 | 10/2019 | Brown et al. | |
| 2019/0320866 | A1 | 10/2019 | Thorne et al. | |
| 2019/0335968 | A1 | 11/2019 | Harting et al. | |
| 2019/0343349 | A1 | 11/2019 | Clare et al. | |
| 2019/0357740 | A1 | 11/2019 | Thorne et al. | |
| 2019/0357741 | A1 * | 11/2019 | Conrad | A47L 9/2884 |
| 2020/0000298 | A1 | 1/2020 | Brown et al. | |
| 2020/0022543 | A1 | 1/2020 | Gill et al. | |
| 2020/0022544 | A1 | 1/2020 | Gill et al. | |
| 2020/0022553 | A1 | 1/2020 | Gill et al. | |
| 2020/0037833 | A1 * | 2/2020 | Niedzwecki | A47L 5/36 |
| 2020/0037843 | A1 | 2/2020 | Fiebig et al. | |
| 2020/0046184 | A1 | 2/2020 | Freese et al. | |
| 2020/0077855 | A1 | 3/2020 | Brown et al. | |
| 2020/0085267 | A1 | 3/2020 | Thorne et al. | |
| 2020/0085269 | A1 | 3/2020 | Thorne | |
| 2020/0121144 | A1 | 4/2020 | Gacin et al. | |
| 2020/0121148 | A1 | 4/2020 | Hoffman et al. | |
| 2020/0138260 | A1 | 5/2020 | Sutter et al. | |
| 2020/0166949 | A1 | 5/2020 | Leech et al. | |
| 2020/0170470 | A1 | 6/2020 | Liggett et al. | |
| 2020/0201348 | A1 | 6/2020 | Leech | |
| 2020/0205631 | A1 | 7/2020 | Brown et al. | |
| 2020/0205634 | A1 | 7/2020 | Sutter et al. | |
| 2020/0237171 | A1 | 7/2020 | Xu et al. | |
| 2020/0288929 | A1 | 9/2020 | Brunner | |
| 2020/0288930 | A1 | 9/2020 | Wells | |
| 2020/0297172 | A1 | 9/2020 | Tonderys et al. | |
| 2020/0301430 | A1 | 9/2020 | Irkliy et al. | |
| 2020/0315418 | A1 | 10/2020 | Howard et al. | |
| 2020/0345196 | A1 | 11/2020 | Innes et al. | |
| 2020/0367711 | A1 | 11/2020 | Thorne et al. | |
| 2020/0371526 | A1 | 11/2020 | Kamada | |
| 2020/0383547 | A1 | 12/2020 | Sutter et al. | |
| 2021/0007569 | A1 | 1/2021 | Howard et al. | |
| 2021/0022574 | A1 | 1/2021 | Harting | |
| 2021/0030227 | A1 | 2/2021 | Mathieu et al. | |
| 2021/0038032 | A1 | 2/2021 | Brown | |
| 2021/0059495 | A1 | 3/2021 | Gill et al. | |
| 2021/0085144 | A1 | 3/2021 | Woodrow et al. | |
| 2021/0169289 | A1 | 6/2021 | Thorne et al. | |
| 2021/0175772 | A1 | 6/2021 | Aini | |
| 2021/0177223 | A1 | 6/2021 | Der Marderosian et al. | |
| 2021/0186282 | A1 | 6/2021 | Mathieu et al. | |
| 2021/0204684 | A1 | 7/2021 | Heman-Ackah et al. | |
| 2021/0228032 | A1 * | 7/2021 | Conrad | A47L 9/122 |
| 2021/0254615 | A1 | 8/2021 | Vrdoljak et al. | |
| 2021/0307581 | A1 | 10/2021 | Thorne et al. | |
| 2021/0315428 | A1 | 10/2021 | Udy et al. | |
| 2021/0345848 | A1 * | 11/2021 | Jeon | A47L 9/0063 |
| 2021/0386261 | A1 | 12/2021 | Woodrow et al. | |
| 2021/0386262 | A1 | 12/2021 | Uchendu et al. | |
| 2022/0031131 | A1 | 2/2022 | McClay et al. | |
| 2022/0031133 | A1 | 2/2022 | Der Marderosian et al. | |
| 2022/0031134 | A1 | 2/2022 | Yang et al. | |
| 2022/0061614 | A1 | 3/2022 | Yu et al. | |
| 2022/0071459 | A1 | 3/2022 | Gacin et al. | |
| 2022/0095864 | A1 | 3/2022 | Der Marderosian et al. | |
| 2022/0125256 | A1 | 4/2022 | Lessard et al. | |
| 2022/0133111 | A1 * | 5/2022 | Conrad | A47L 9/02 15/329 |
| 2023/0115062 | A1 * | 4/2023 | Niedzwecki | A47L 9/2884 15/328 |
| 2023/0248192 | A1 | 8/2023 | Brown et al. | |

FOREIGN PATENT DOCUMENTS

| | | | | |
|---|---|---|---|---|
| CN | 108113571 | | 6/2018 | |
| CN | 108113571 | A * | 6/2018 | A47L 5/24 |
| CN | 207444893 | | 6/2018 | |
| DE | 102008034458 | | 1/2010 | |
| EP | 1908386 | | 4/2008 | |
| EP | 2100546 | | 9/2009 | |
| JP | 2007301260 | | 11/2007 | |
| JP | 2010194070 | | 9/2010 | |

(56) References Cited

FOREIGN PATENT DOCUMENTS

| | | | | |
|---|---|---|---|---|
| JP | 2013162882 | | 8/2013 | |
| JP | 2019030554 | | 2/2019 | |
| JP | 2019030554 A | * | 2/2019 | ..... A47L 5/12 |
| JP | 2019030555 | | 2/2019 | |

OTHER PUBLICATIONS

PCT Search Report and Written Opinion mailed Oct. 25, 2019, received in PCT Application No. PCT/US19/44483, 9 pgs.
Chinese Office Action with English translation issued Jun. 2, 2021, received in Chinese Patent Application No. 201980020798.7, 11 pages.
Chinese Office Action with English translation issued Sep. 13, 2021, received in Chinese Patent Application No. 201980062711.2, 11 pages.
US Office action issued Dec. 10, 2021, received in U.S. Appl. No. 16/270,078, 21 pages.
European Extended Search Report issued Feb. 10, 2022, received in European Patent Application No. 19750309.7, 10 pages.
Chinese Office Action with English translation issued Mar. 2, 2022, received in Chinese Patent Application No. 201980020798.7, 5 pages.
Australian Examination Report issued Mar. 3, 2022, received in Australian Patent Application No. 2019312591, 3 pages.
European Extended Search Report issued May 10, 2022, received in European Patent Application No. 19845568.5, 8 pages.
Canadian Examiner Report issued Jun. 23, 2022, received in Canadian Patent Application No. 3,112,975, 4 pages.
US Office action issued Jul. 21, 2022, received in U.S. Appl. No. 16/270,078, 13 pages.
Australian Examination Report No. 2 issued Feb. 20, 2023, received in Australian Patent Application No. 2019312591, 4 pages.
Chinese Office Action with English language translated cover sheet issued Mar. 28, 2023, received in Chinese Patent Application No. 202210749672.7, 10 pages.
Extended European Search Report issued Jun. 24, 2025, received in European Patent Application No. 25162090.2, 8 pages.

* cited by examiner

UPRIGHT SURFACE TREATMENT APPARATUS HAVING REMOVABLE POD

CROSS-REFERENCE TO RELATED APPLICATIONS

The present application claims the benefit of U.S. Provisional Application Ser. No. 62/712,634 filed on Jul. 31, 2018, entitled Upright Surface Treatment Apparatus having Removable Pod and the present application is a Continuation-in-Part of U.S. patent application Ser. No. 16/270,078 filed on Feb. 7, 2019, entitled Accessories for a Surface Treatment Apparatus having a Plurality of Operational States and Surface Treatment Apparatus configured to Actuate the same, each of which are fully incorporated herein by reference.

TECHNICAL FIELD

The present disclosure is generally directed to surface treatment apparatuses and more specifically to a reconfigurable surface treatment apparatus having a removable pod.

BACKGROUND INFORMATION

Surface treatment apparatuses can include upright vacuum cleaners configured to be transitionable between a storage position and an in-use position. Upright vacuum cleaners can include a suction motor configured to draw air into an air inlet of the upright vacuum cleaner such that debris deposited on a surface can be urged into the air inlet. At least a portion of the debris urged into the air inlet can be deposited within a dust storage container within the upright vacuum cleaner for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a reconfigurable surface treatment apparatus. The surface treatment apparatus includes an upright section configured to couple to a pod. The upright section includes a wand having a first distal end configured to couple to a surface cleaning head and a second distal end, opposite the first distal end, configured to couple to a handle. The pod is configured to removably couple to a portion of the wand extending between the first and second distal ends. The pod includes a suction motor assembly cavity configured to receive a suction motor and a premotor filter, a dust cup cavity configured to receive a dust cup, and a power source cavity configured to receive a power source (e.g., one or more batteries). The suction motor assembly cavity and the power source cavity extend along opposite sides of a vertical plane extending along a central longitudinal axis of the pod and the dust cup cavity extends along the vertical plane such that at least a portion of the dust cup is disposed on each side of the vertical plane. Such a configuration may result in a center of gravity of the pod being generally aligned with the wand when the pod is coupled to the wand. As such, when a user is operating the surface treatment apparatus, the surface treatment apparatus may feel substantially balanced, potentially reducing user fatigue.

Figure 1:
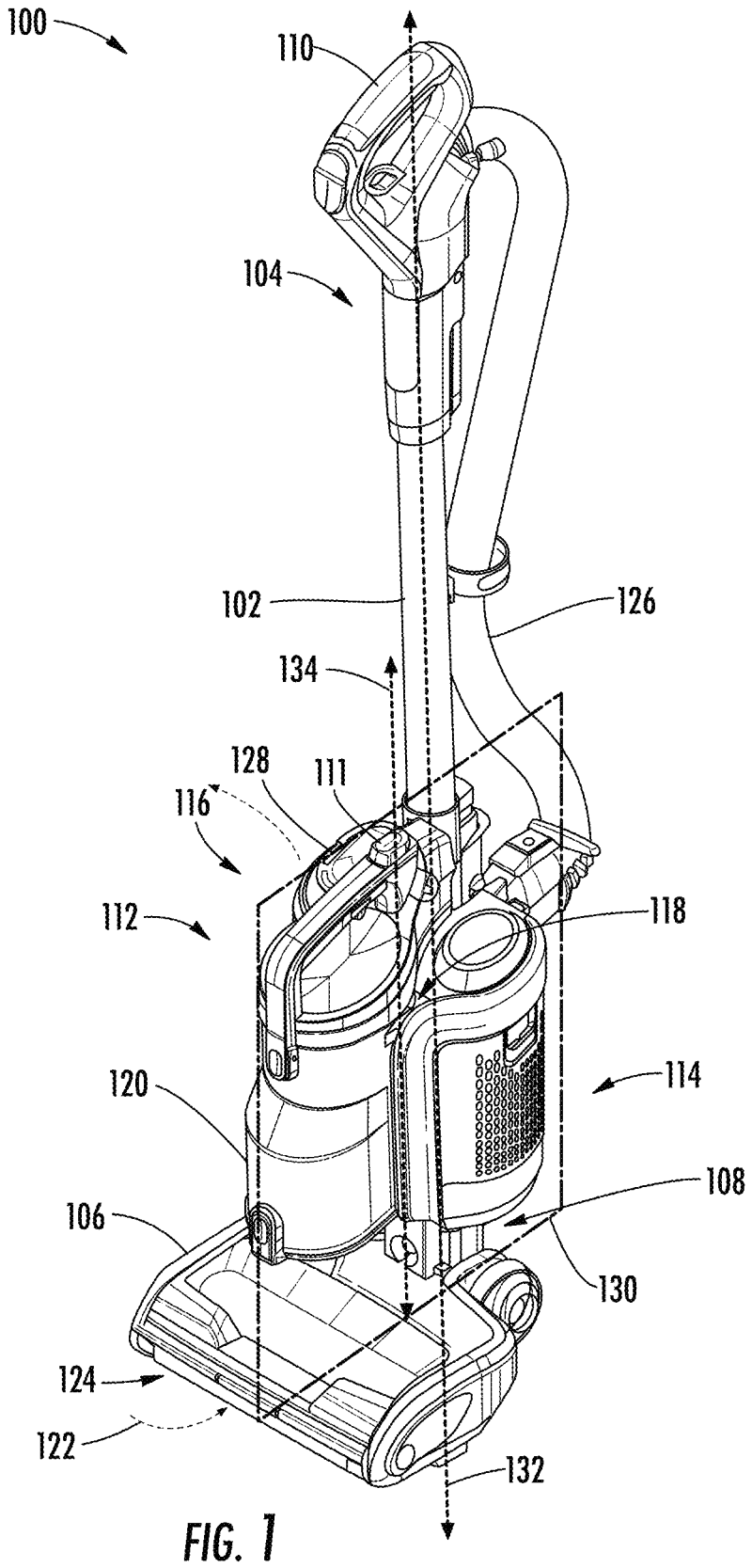
FIG. 1 is a perspective view of an example of a surface treatment apparatus having a pod, a wand, and a surface cleaning head, consistent with embodiments of the present disclosure.

FIG. 1 shows a perspective view an upright surface treatment apparatus 100 having a wand 102, wherein a first distal end 104 of the wand 102 is coupled to a surface cleaning head 106 and a second distal end 108 of the wand 102 is coupled to a cleaner handle 110, the first distal end 104 being opposite the second distal end 108. As shown, a pod 112 may be coupled to the wand 102 at a location between the first and second distal ends 104 and 108. The pod 112 can be removably coupled to the wand 102 such that the pod 112 can be carried by a user independently of the wand 102. For example, a user may actuate a toggle (e.g., button) 111 configured to cause an engagement mechanism (e.g., a latch) to transition between an engaging state and a disengaging state to decouple the pod 112 from the wand 102.

As shown, the pod 112 includes a suction motor assembly cavity 114 configured to receive a suction motor, a battery cavity 116 configured to receive a power source (e.g., a battery), and a dust cup cavity 118 configured to receive a dust cup 120. An air flow path 122 may extend from an air inlet 124 of the surface cleaning head 106, through the wand 102 and a flexible conduit 126 (e.g., a non-electrified hose or an electrified hose) and into the dust cup 120. As such, the flexible conduit 126 may generally be described as fluidly coupling the pod 112 to the wand 102. The dust cup 120 can be configured such that a cyclone is generated within the dust cup 120. As such, before exiting the dust cup 120, at least a portion of any debris entrained within the air extending along the air flow path 122 is deposited within the dust cup 120 due to a cyclonic motion of the air. After exiting the dust cup 120 the air flow path 122 extends into a premotor filter within the suction motor assembly cavity 114 and passes through a suction motor disposed within suction motor assembly cavity 114. After passing through the suction motor, the air flow path 122 extends into the battery cavity 116 and provides cooling to a battery pack 128 (e.g., having one or more batteries) disposed within the battery cavity 116. In some instances, a post motor filter medium may be positioned within the air flow path 122 (e.g., battery cavity 116) such that the air flow path 122 passes through the post motor filter medium before to passing through the battery pack 128. This may reduce the quantity of debris that collects in the battery pack 128. The post motor filter medium may be a high efficiency particulate air (HEPA) filter. As such, the suction motor assembly cavity 114 may generally be described as being fluidly coupled to the battery cavity 116 when the dust cup 120 is received within the dust cup cavity 118.

As also shown, the suction motor assembly cavity 114 and the battery cavity 116 are disposed on opposing sides of a vertical plane 130 extending through a center of the pod 112. In some instances, the vertical plane 130 may include a central longitudinal axis 132 of the wand 102 and/or a central longitudinal axis 134 of the pod 112. The central longitudinal axis 134 of the pod 112, when the pod 112 is coupled to the wand 102, extends substantially parallel to the central longitudinal axis 132 of the wand 102. At least a portion of the dust cup cavity 118 is disposed between the suction motor assembly cavity 114 and the battery cavity 116 such that a portion of the dust cup 120 is disposed on opposing sides of the vertical plane 130. For example, the dust cup cavity 118 can be positioned such that the portions of the dust cup cavity 118 on opposing sides of the vertical plane 130 are substantially equal. Therefore, the dust cup 120 may generally be described as having substantially equal portions disposed on opposing sides of the vertical plane 130 when received within the dust cup cavity 118. As such, the pod 112 may generally be described as being substantially balanced across the vertical plane 130 when fully assembled (e.g., when the battery pack 128, the suction motor, the premotor filter, and the dust cup 120 are coupled to the pod 112).

Figure 2A:
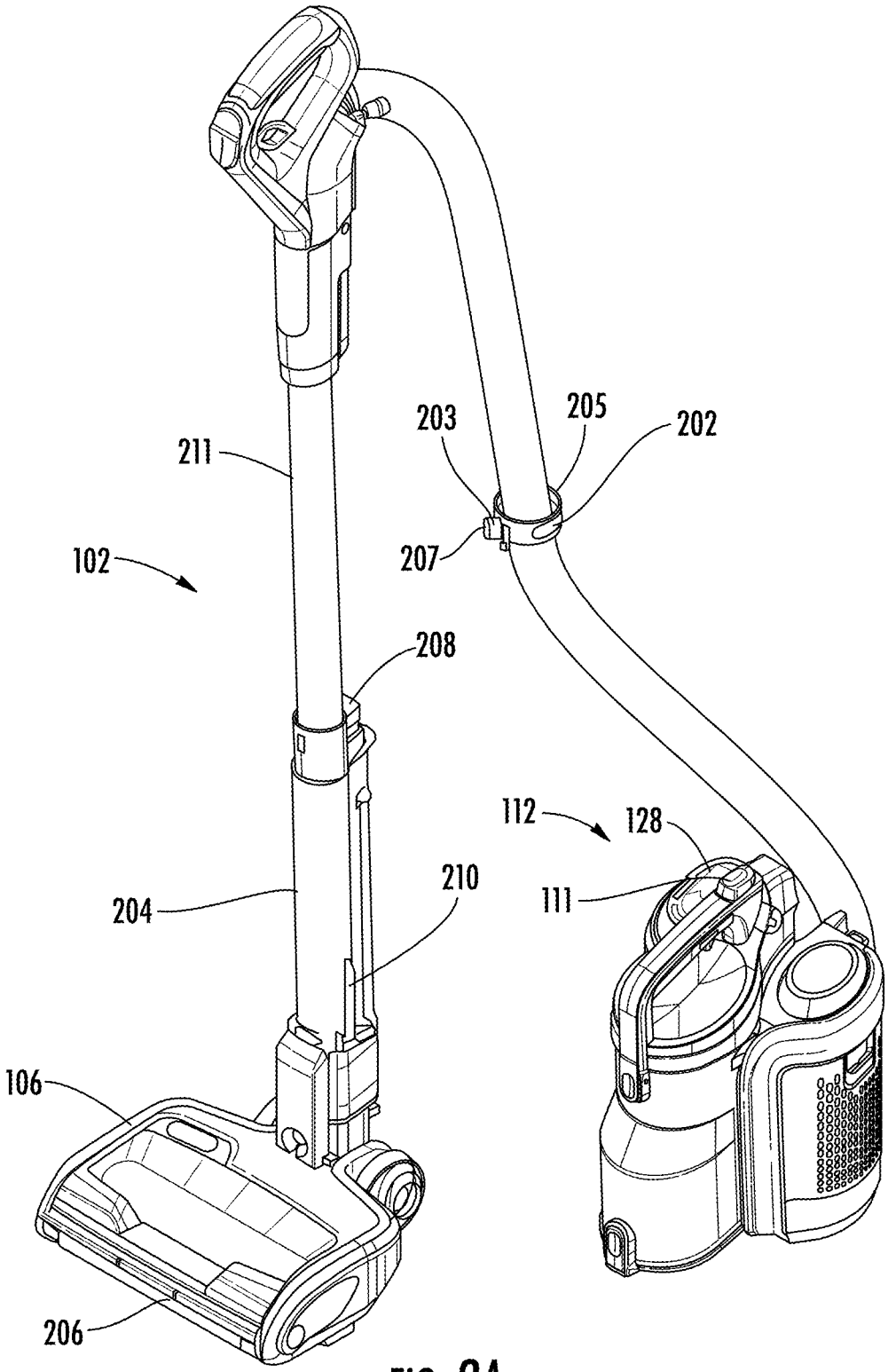
FIG. 2A is a perspective view of the surface treatment apparatus of FIG. 1 having the pod decoupled from the wand, consistent with embodiments of the present disclosure.

FIG. 2A shows a perspective view of the pod 112 decoupled from the wand 102 in response to actuation of the toggle 111. As shown, when the pod 112 is decoupled from the wand 102, a clip 202 configured to couple the flexible conduit 126 to the wand 102 decouples from the wand 102. As such, the wand 102 may be maneuvered independently from the pod 112. The clip 202 can include a plurality of protrusions 203 extending from a body 205 of the clip 202. The protrusions 203 may include one or more ribs 207 configured to engage a corresponding portion of the wand 102 (e.g., a groove extending along the wand 102). The clip 202 can be configured to slide along the wand 102.

Figure 2B:
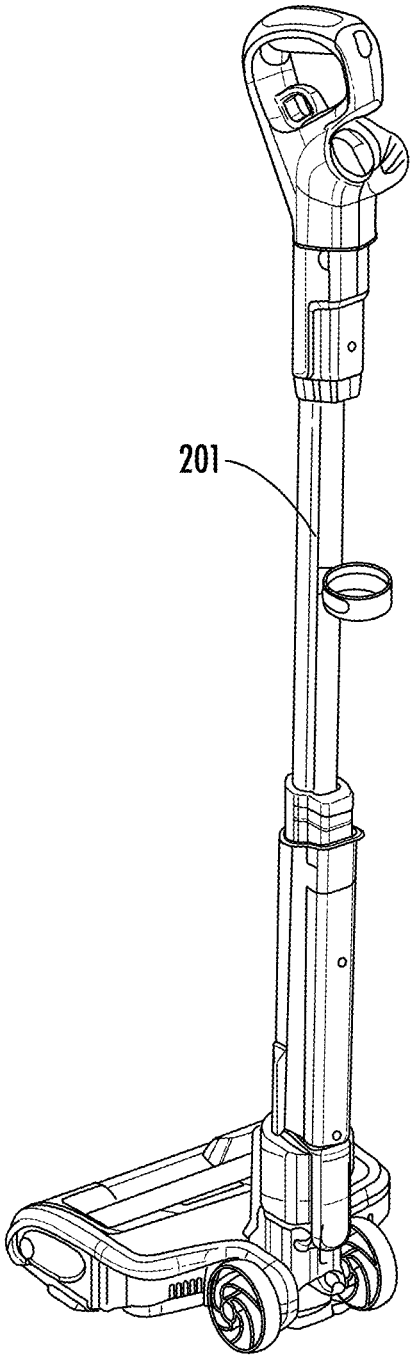
FIG. 2B is a perspective rear view of the surface treatment apparatus of FIG. 1 having the pod and flexible conduit removed for purposes of clarity, consistent with embodiments of the present disclosure.

FIG. 2B shows a rear perspective view of surface treatment apparatus 100 having the pod 112 and the flexible conduit 126 removed therefrom for purposes of clarity. As shown, at least a portion of the wand 102 includes grooves 201 for coupling to the clip 202.

Referring again to FIG. 2A, the wand 102 is configured such that at least a portion of the wand 102 may be decoupled from the surface cleaning head 106. For example, and as shown, the wand 102 includes a neck 204 that is coupled to the surface cleaning head 106 and a detachable portion 211. The detachable portion 211 is separable from the neck 204 and can be used independently of the neck 204 and the surface cleaning head 106. Therefore, when the pod 112 is decoupled from the wand 102 (e.g., the neck 204) the pod 112 and the detachable portion 211 can be maneuvered independently of the surface cleaning head 106 and the neck 204. As such, when the pod 112 is fluidly decoupled from the surface cleaning head 106 only a portion of the wand may be fluidly coupled to the pod 112.

The neck 204 may define a portion of a latching mechanism. The latching mechanism is actuated in response to pressing of a release toggle (e.g., button) 208. When the release toggle 208 is actuated, the detachable portion 211 of the wand 102 is separable from the neck 204. In some instances, a biasing mechanism (e.g., a spring) may disposed within the neck 204 such that the biasing mechanism urges the detachable portion 211 of the wand 102 in a direction out of the neck 204. In these instances, when the release toggle 208 is depressed, the detachable portion 211 of the wand 102 may be urged at least partially out of the neck 204.

The neck 204 can also include a plurality of alignment features 210 for aligning the pod 112 when coupling the pod 112 to the wand 102 (e.g., the neck 204). For example, and as shown, the alignment features 210 may include an elongated protrusion extending from the neck 204 and configured to engage a corresponding groove defined in the pod 112. The alignment features 210 can also be configured to cooperate with the engagement mechanism for coupling the pod 112 to the wand 102.

The neck 204 defines a fluid pathway that fluidly couples the pod 112 to the surface cleaning head 106. The neck 204 can also include one or more electrical contacts configured to electrically couple the battery pack 128 to the surface cleaning head 106. For example, the battery pack 128 may be configured to power one or more brush rolls 206 disposed within the surface cleaning head 106 and/or one or more light sources (e.g., light emitting diodes, incandescent lamps, and/or any other light source).

Figure 3:
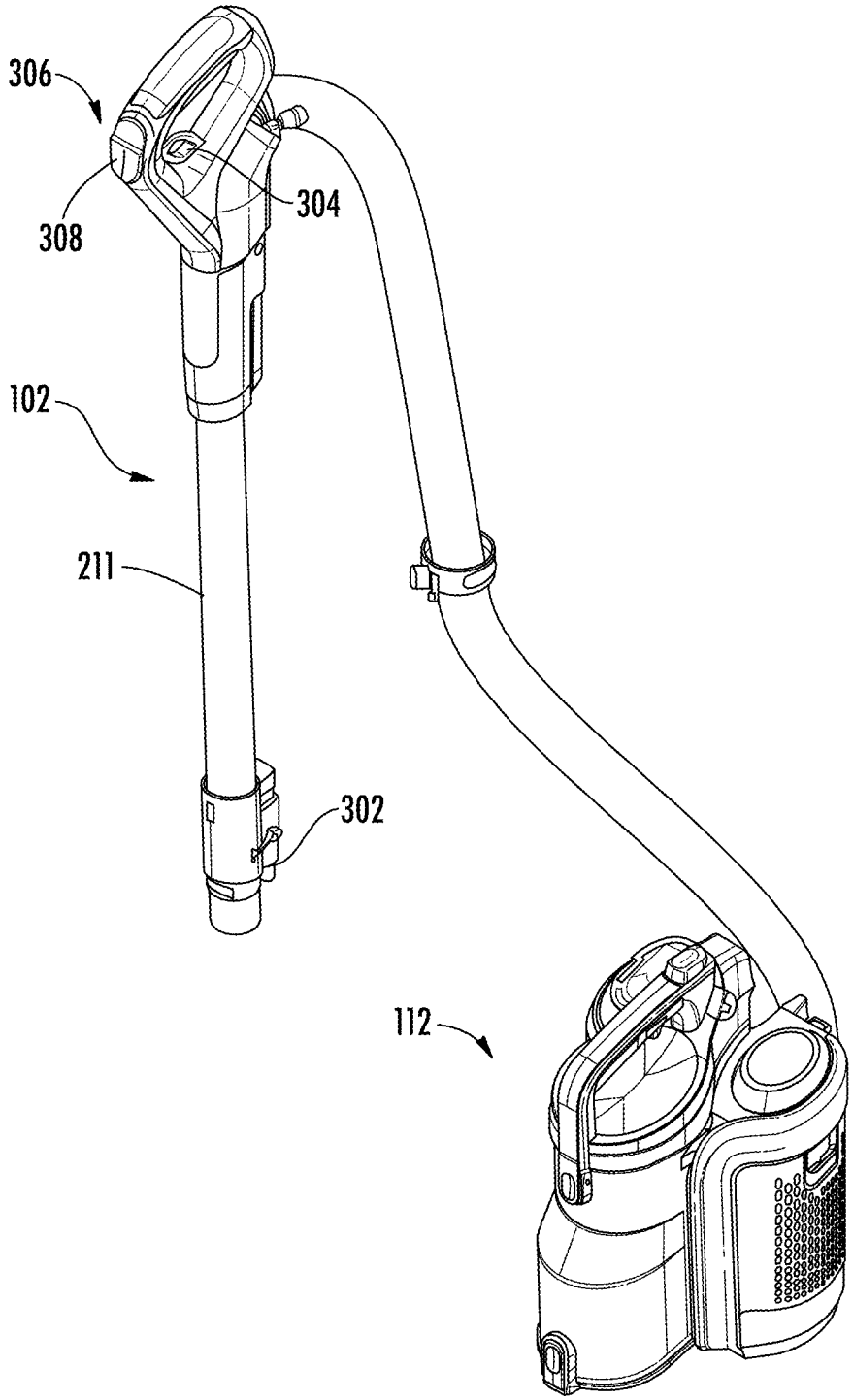
FIG. 3 is a perspective view of the surface treatment apparatus of FIG. 2A having the surface cleaning head and a portion of the wand removed therefrom, consistent with embodiments of the present disclosure.

FIG. 3 shows a perspective view of the pod 112 decoupled from the wand 102 and the detachable portion 211 of the wand 102 decoupled from the neck 204. As shown, the detachable portion 211 of the wand 102 includes electrical contacts 302 corresponding to electrical contacts in the neck 204 such that the battery pack 128 can be electrically coupled to the surface cleaning head 106.

The cleaner handle 110 can include a toggle (e.g., a trigger) 304 configured to actuate a latching mechanism that removably couples the cleaner handle 110 to the detachable portion 211 of the wand 102. For example, the toggle 304 can be configured to transition the latching mechanism from a latching state to a delatching state in response to a user pulling the toggle 304 in a direction generally away from the detachable portion 211 of the wand 102.

The cleaner handle 110 can also include a user interface 306 having a plurality of buttons 308. Each button 308 can cause the surface treatment apparatus 100 to function differently. For example, there can be one or more buttons that correspond to suction power, floor surface type, and/or any other function. In some instances, one or more buttons 308 can control the surface cleaning head 106. For example, one or more buttons 308 can enable and/or disable one or more brush rolls, light sources, and/or any other function. One of the one or more buttons 308 can correspond to a power button for the entire surface treatment apparatus 100.

Figure 4:
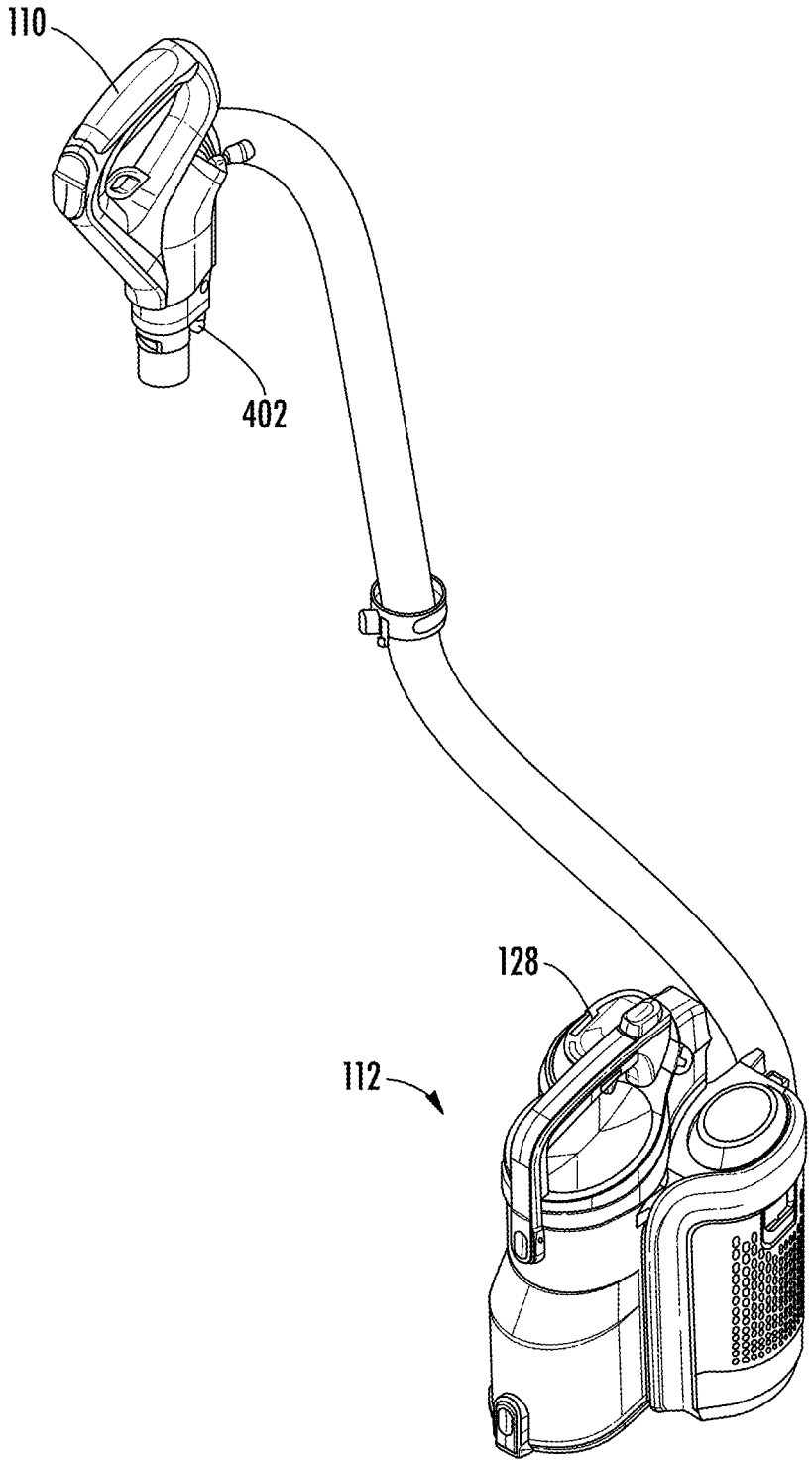
FIG. 4 is a perspective view of the surface treatment apparatus of FIG. 3 having the detachable portion of the wand removed therefrom, consistent with embodiments of the present disclosure.

FIG. 4 shows a perspective view of the pod 112 decoupled from the wand 102 and the cleaner handle 110 decoupled from the wand 102. As shown, the cleaner handle 110 can include electrical contacts 402 configured to electrically couple the cleaner handle 110 to the wand 102 such that the battery pack 128 can be electrically coupled to the surface cleaning head 106. In some instances, the cleaner handle 110 (and/or or the detachable portion 211 of the wand 102) can be configured to couple to one or more surface cleaning accessories.

Figure 5:
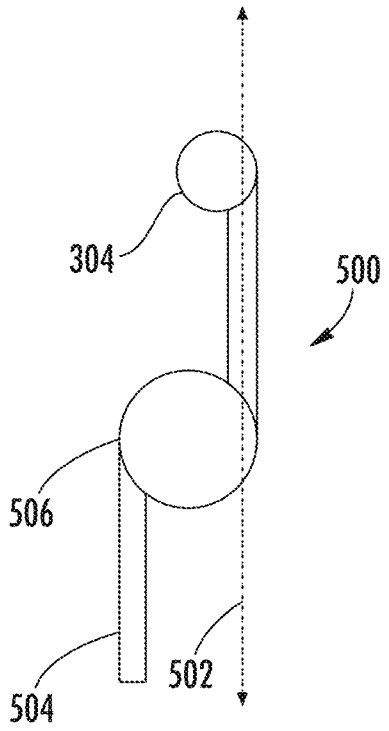
FIG. 5 is a schematic view of an example of a toggle coupled to a toggling mechanism, consistent with embodiments of the present disclosure.

FIG. 5 shows a schematic view of an example of the toggle 304 coupled to a toggling mechanism 500 configured to transition the latching mechanism between a latching and delatching state. The toggling mechanism 500 includes a plunger portion 504 configured to actuate the latching mechanism and a pivoting collar 506. For example, when the toggle 304 is pulled along an actuation axis 502, the pivoting collar 506 is caused to rotate. Rotation of the pivoting collar 506 causes the plunger portion 504 to be urged in a direction away from the toggle 304 and generally parallel to the actuation axis 502. In other words, the toggling mechanism 500 can generally be described as being configured to convert a pull motion into a push motion.

Figure 5B:
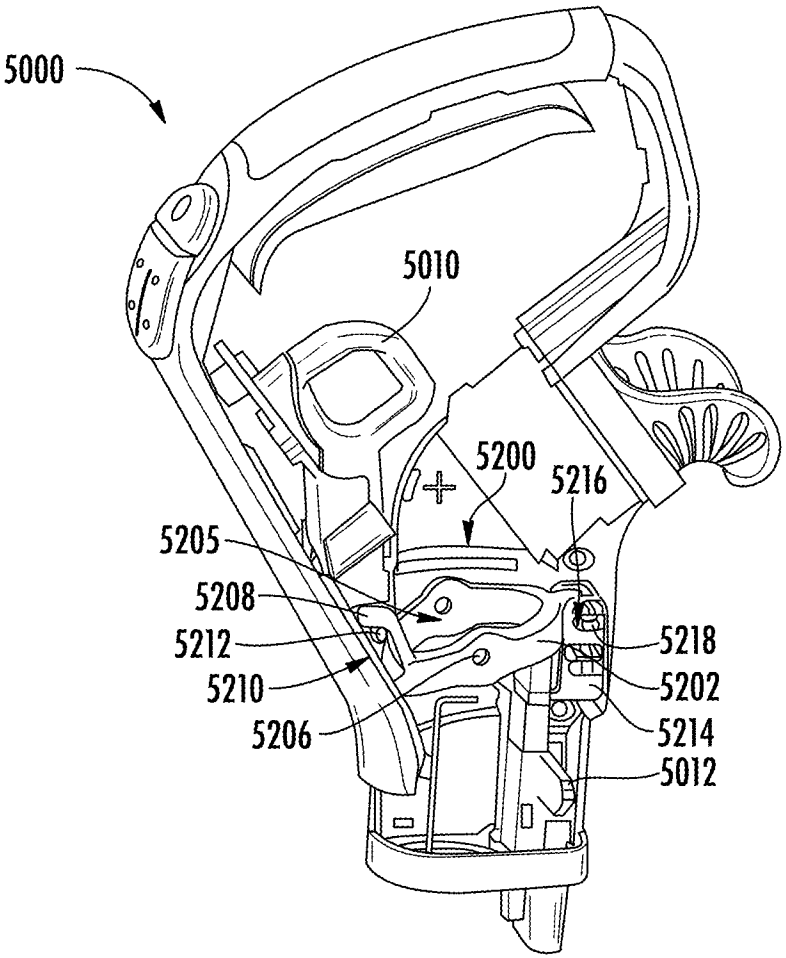
FIG. 5B is another perspective view of the handle assembly of FIG. 5A, consistent with embodiments of the present disclosure.
Figure 5A:
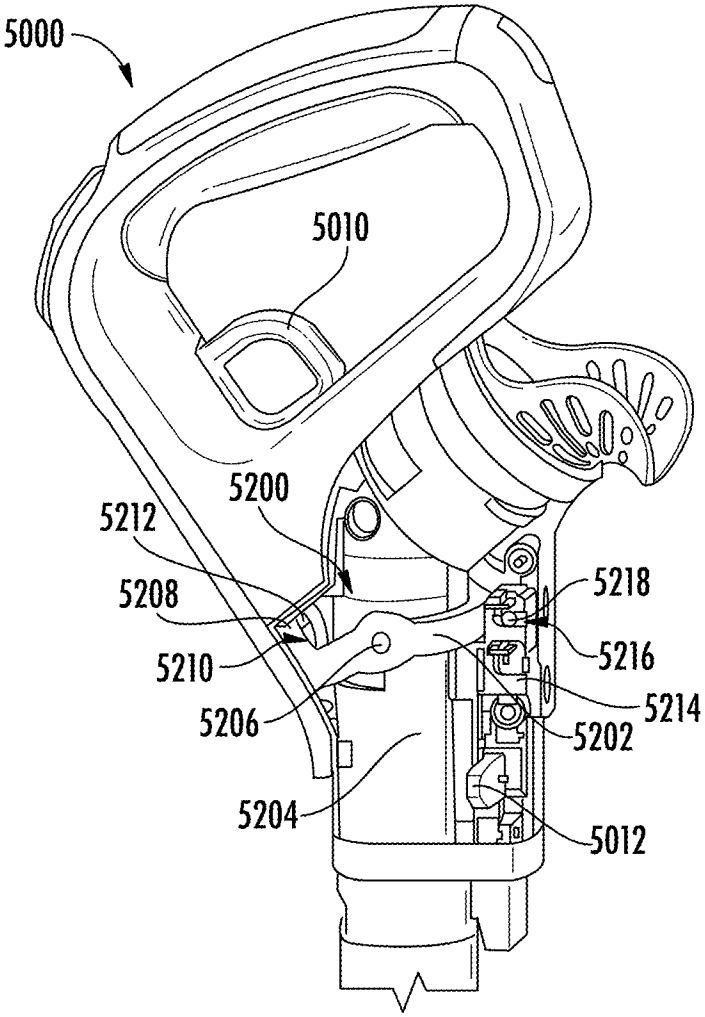
FIG. 5A is a perspective view of an example of a handle assembly having a toggling mechanism, wherein a portion of the handle assembly housing is removed therefrom for purposes of clarity, consistent with embodiments of the present disclosure.

FIGS. 5A and 5B show a perspective view of a handle assembly 5000, which may be an example of the handle 110 of FIG. 1, having portions removed therefrom for purposes illustrating a pivot linkage 5200, the pivot linkage 5200 may be an example of the toggling mechanism 500 of FIG. 5. As shown, the pivot linkage 5200 includes a pivot body 5202 that is pivotally coupled to an air guide 5204 such that the pivot body 5202 pivots about a body pivot point 5206. The pivot body 5202 can extend, at least partially, around the air guide 5204. For example, an air guide 5204 can extend through an opening 5205 extending through the pivot body 5202.

The pivot body 5202 can be coupled to a toggle 5010 (e.g., trigger) such that actuation of the toggle 5010 causes the pivot body 5202 to pivot about the body pivot point 5206. The pivot body 5202 can also be coupled to an actuator 5214 such that pivoting of the pivot body 5202 about the body pivot point 5206 causes the actuator 5214 to transition between actuated and unactuated states. As the actuator 5214 transitions towards the actuated state, a latch 5012 can be urged towards a delatched state (e.g., the latch 5012 comes out of engagement with a catch). The toggle 5010 and the actuator 5214 can be coupled to opposing sides of the pivot body 5202 relative to a pivot axis defined by the body pivot point 5206.

As shown, the pivot body 5202 can include an arm 5208 that defines an arm slot 5210 that corresponds to at least one toggle protrusion 5212 extending from the toggle 5010. The toggle protrusion 5212 is configured to be able slide within the arm slot 5210. As such, the latch 5012 can be actuated without actuating the toggle 5010. The actuator 5214 can define an actuator slot 5216 configured to receive at least one corresponding body protrusion 5218. The body protrusion 5218 can be configured to slide within the actuator slot 5216. In some instances, one or more of the toggle 5010, the pivot linkage 5200, and/or the actuator 5214 may engage and/or include a biasing mechanism that biases the actuator 5214 towards, for example, the unactuated state. The biasing mechanism may be, for example, a spring (e.g., a tension spring, a torsion spring, a compression spring, and/or any other suitable spring), an elastic material (e.g., a rubber), and/or any other suitable biasing mechanism.

Figure 6:
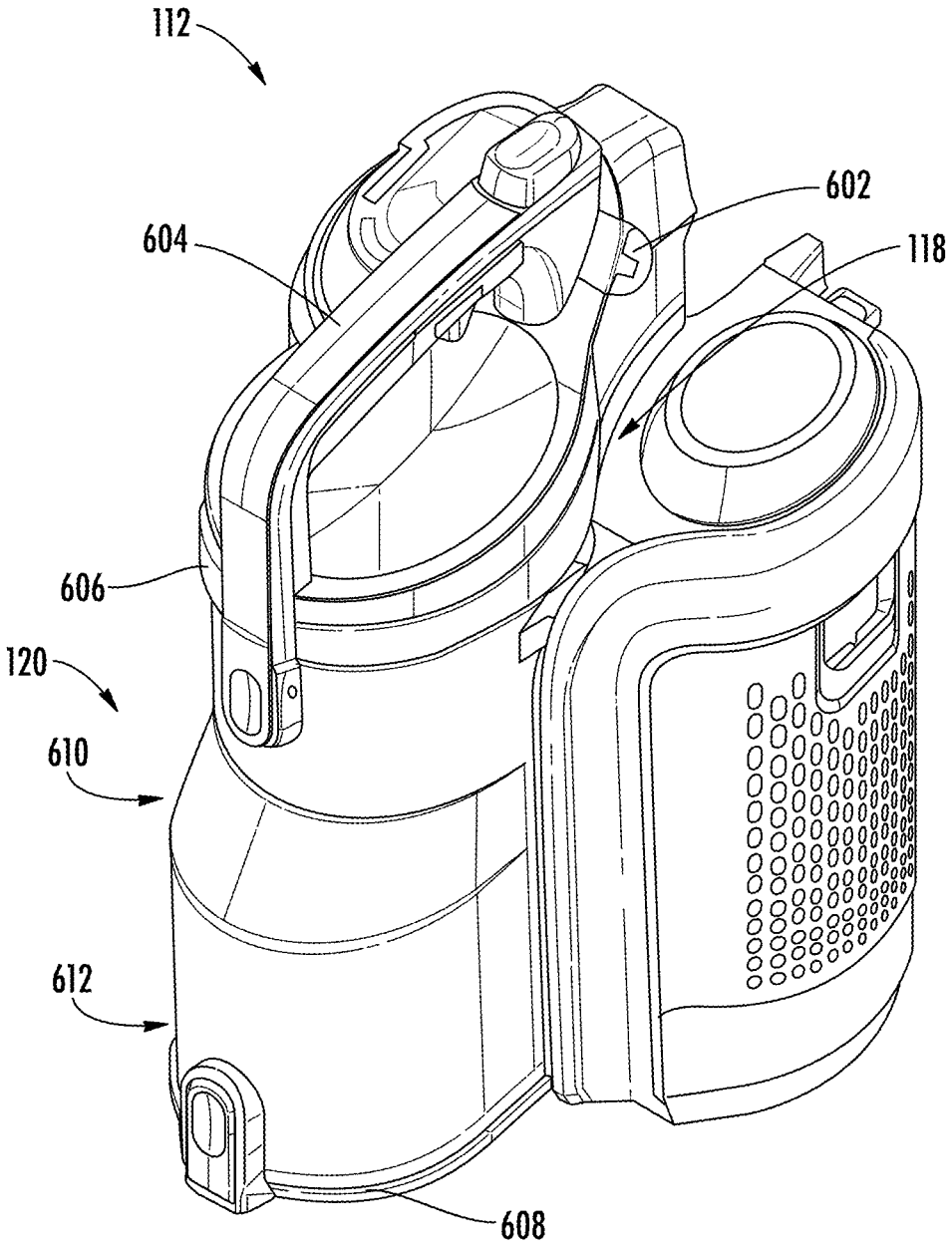
FIG. 6 is a perspective view of the pod of FIG. 1 having a dust cup and a battery pack coupled thereto, consistent with embodiments of the present disclosure.

FIG. 6 shows a perspective view of the pod 112 decoupled from the flexible conduit 126 and the wand 102. As shown, the dust cup 120 is configured to couple to the pod 112 at the dust cup cavity 118. The dust cup 120 can include a latching mechanism 602 configured to removably couple the dust cup 120 to the pod 112. The dust cup 120 can also include a dust cup handle 604 configured to allow the dust cup 120 to be carried by a user and/or the pod 112 (when the dust cup 120 is coupled to the pod 112) to be carried by the user. The dust cup 120 can also include a first openable door 606 coupled to the dust cup handle 604 and a second openable door 608 on an opposite end of the dust cup 120.

The dust cup 120 can also be configured to generate a cyclone. For example, the dust cup 120 can have a cyclone portion 610 and a collection portion 612 for collecting debris. As shown, cyclone portion 610 may be positioned above the collection portion 612.

Figure 7:
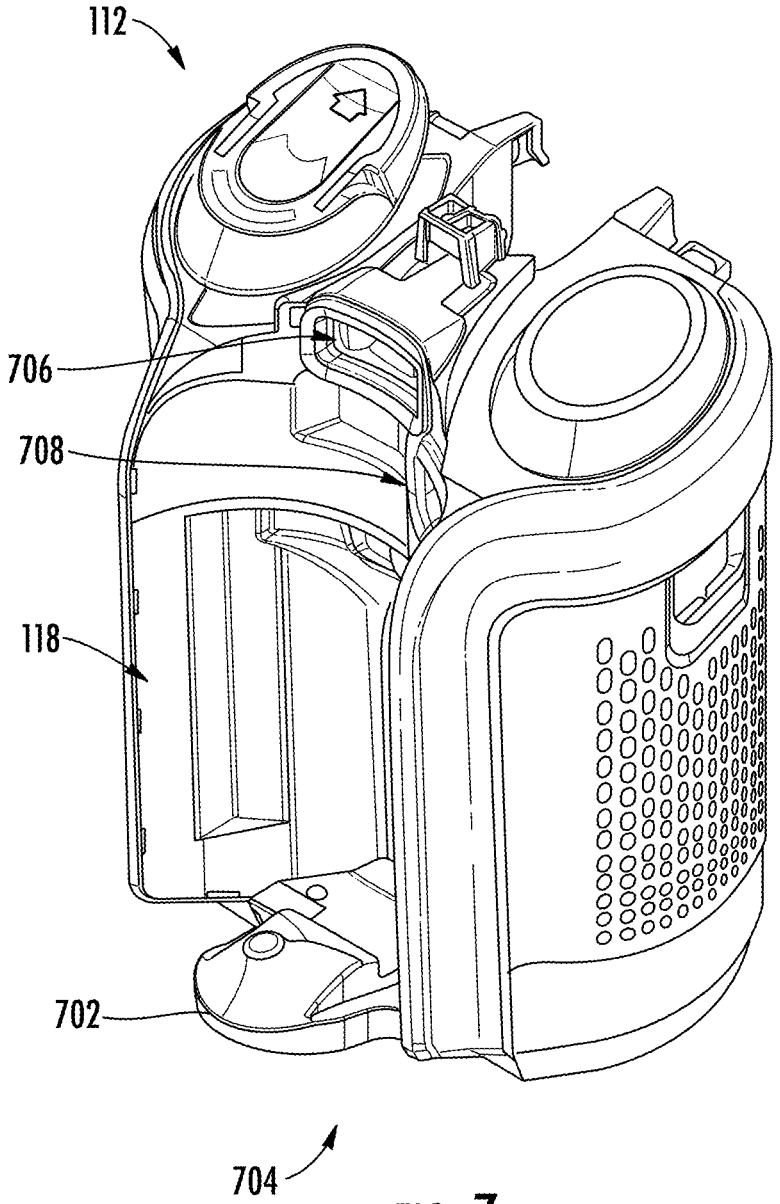
FIG. 7 is a perspective view of the pod of FIG. 6 having the dust cup removed therefrom, consistent with embodiments of the present disclosure.

FIG. 7 shows a perspective view of the pod 112 having the dust cup 120 decoupled therefrom. As shown, the dust cup cavity 118 includes a protrusion 702 extending from a base portion 704 of the pod 112. The protrusion 702 is configured to engage the dust cup 120 such that the protrusion 702 aligns the dust cup 120 when coupling the dust cup 120 to the pod 112. As shown, the protrusion 702 can include a generally frustoconical shape extending from a portion of the protrusion 702 and the frustoconical shape can be angled outwardly (e.g., away from an operator of the surface treatment apparatus 100 when the pod is coupled to the wand 102).

As also shown, the dust cup cavity 118 defines a suction motor inlet 706 and a dust cup inlet 708. The dust cup inlet 708 is configured to be fluidly coupled to the flexible conduit 126.

Figure 8:
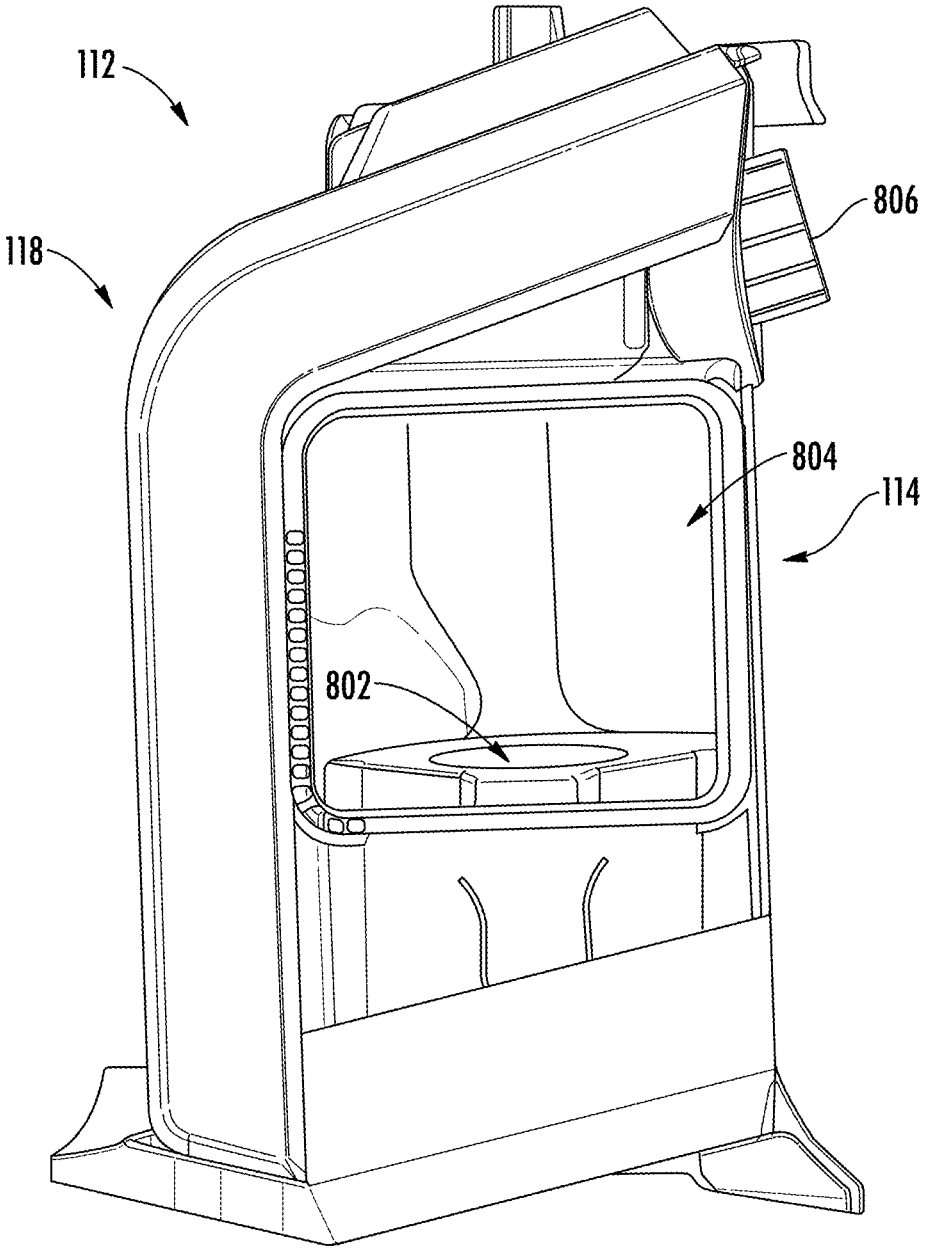
FIG. 8 is a side view of the pod of FIG. 7 having a door enclosing a suction motor assembly cavity removed therefrom, consistent with embodiments of the present disclosure.

FIG. 8 is a side view of the pod 112 having a door, enclosing the suction motor assembly cavity 114, removed. As shown, the suction motor assembly cavity 114 includes a suction motor 802 and a premotor filter cavity 804 configured to receive a premotor filter.

As also shown, the pod 112 can include a flexible conduit coupler 806. The flexible conduit coupler 806 can be positioned on a side of the pod 112 that is opposite of the dust cup cavity 118. Such a configuration may result in an airflow path having more gradual directional transitions when compared to other locations. However, the flexible conduit coupler 806 may be positioned elsewhere on the pod 112. For example, the flexible conduit coupler 806 may be positioned on a top, a bottom, or a side of the pod 112.

Figure 9:
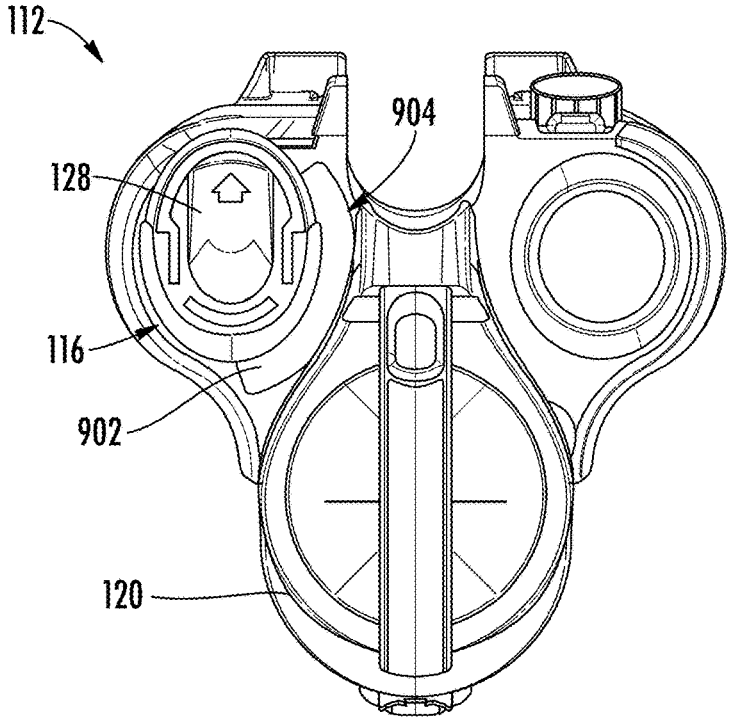
FIG. 9 is a top view of the pod of FIG. 6, consistent with embodiments of the present disclosure.
Figure 10:
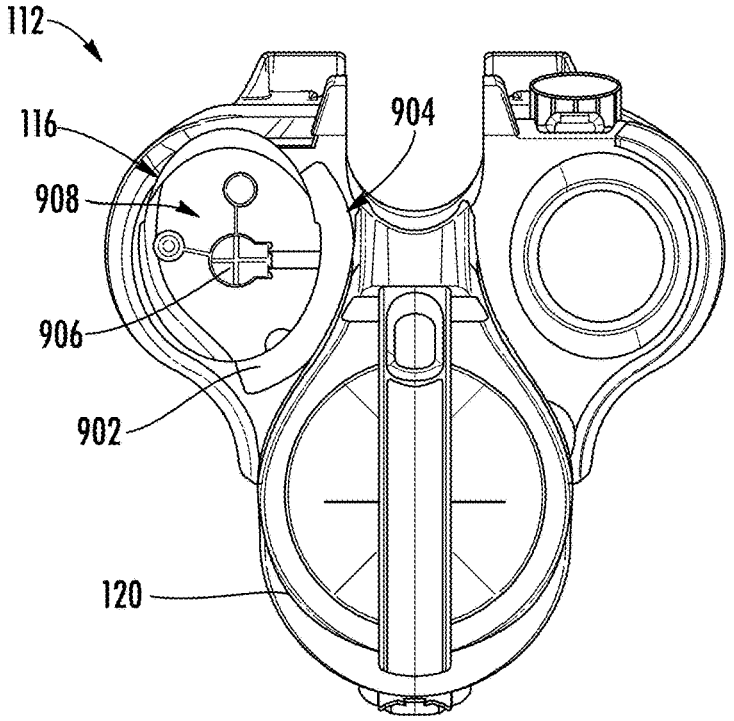
FIG. 10 is a top view of the pod of FIG. 6 having the battery pack removed therefrom, consistent with embodiments of the present disclosure.

FIG. 9 shows a top view of the pod 112 having the battery pack 128 and the dust cup 120 coupled to the pod 112. FIG. 10 shows a top view of the pod 112 having the battery pack 128 removed therefrom and the dust cup 120 coupled to the pod 112. A filter 902 may be disposed within the battery cavity 116 such that the filter 902 is positioned between the battery pack 128 and at least a portion of an inner surface 904 of the battery cavity 116. For example, the filter 902 can be disposed within the air flow path 122 (see FIG. 1) at a location up flow of the battery pack 128. As such, air passes through the filter 902 before passing through the battery pack 128. As previously discussed, exhaust air from the suction motor 802 is used to provide cooling to the battery pack 128. As such, the filter 902 collects at least a portion of any debris still entrained within the air flow, which may reduce a quantity of debris collected in the battery pack 128. The filter 902 may be a high efficiency particulate air (HEPA) filter.

As shown in FIG. 10, the battery cavity 116 includes a battery protrusion 906 extending from a base 908 of the battery cavity 116. The battery protrusion 906 can be configured to transition between a depressible state and a rigid state. For example, the battery protrusion 906 can be configured to transition from the rigid state to the depressible state in response to the filter 902 being received within the battery cavity 116. As such, when the battery pack 128 and the filter 902 are received within the battery cavity 116, the battery pack 128 depresses the battery protrusion 906. Such a configuration may prevent the battery pack 128 from being installed within the battery cavity 116 such that the battery pack 128 forms an electrical coupling with the pod 112 when the filter 902 is not installed.

Figure 11:
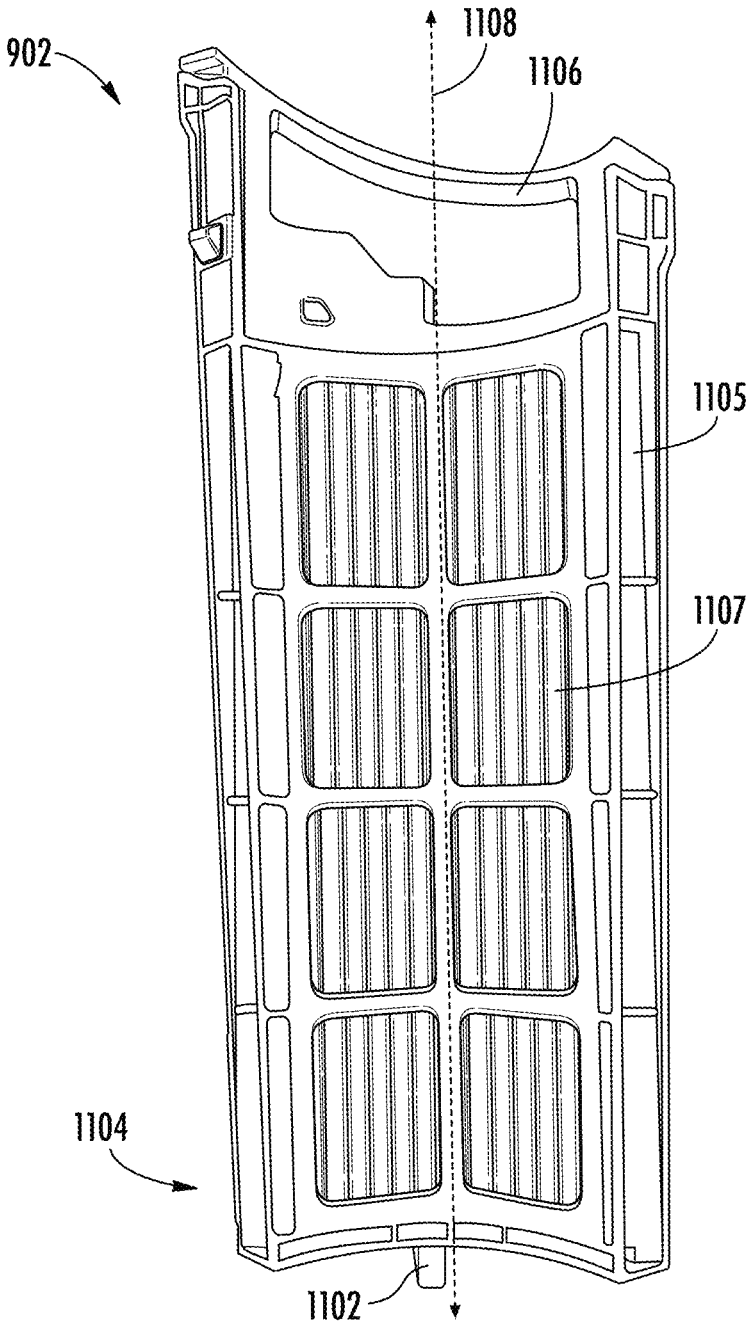
FIG. 11 is a perspective view of a filter configured to be inserted within a battery cavity of the pod of FIG. 6, consistent with embodiments of the present disclosure.

As shown in FIG. 11, the filter 902 may include a filter protrusion 1102 extending from a base portion 1104 of the filter 902 (for example, and as shown, the filter 902 may include a filter frame 1105 extending around a filter medium 1107, wherein the filter protrusion 1102 extends from the filter frame 1105). The filter protrusion 1102 can be configured to engage a latching mechanism that is in communication with the battery protrusion 906. For example, when the filter protrusion 1102 comes into engagement with and actuates the latching mechanism, the battery protrusion 906 transitions from the rigid state to the depressible state such that the battery protrusion 906 can be depressed by the battery pack 128. As a result, the battery pack 128 is able to be properly seated within the battery cavity 116 (e.g., fully inserted such that the battery pack 128 is electrically coupled to the surface cleaning head 106 and/or the suction motor 802). As also shown in FIG. 11, the filter 902 may include a latching mechanism 1106 configured to couple the filter 902 to the pod 112 within the battery cavity 116. For example, the latching mechanism 1106 can be slideably coupled to the filter frame 1105 and configured to move along a longitudinal axis 1108 of the filter 902 between a latching and unlatching position. In some instances, the filter 902 may have a shape that generally corresponds to a shape of the battery cavity 116 (e.g., the filter 902 may have an arcuate shape, as shown).

Figure 14A:
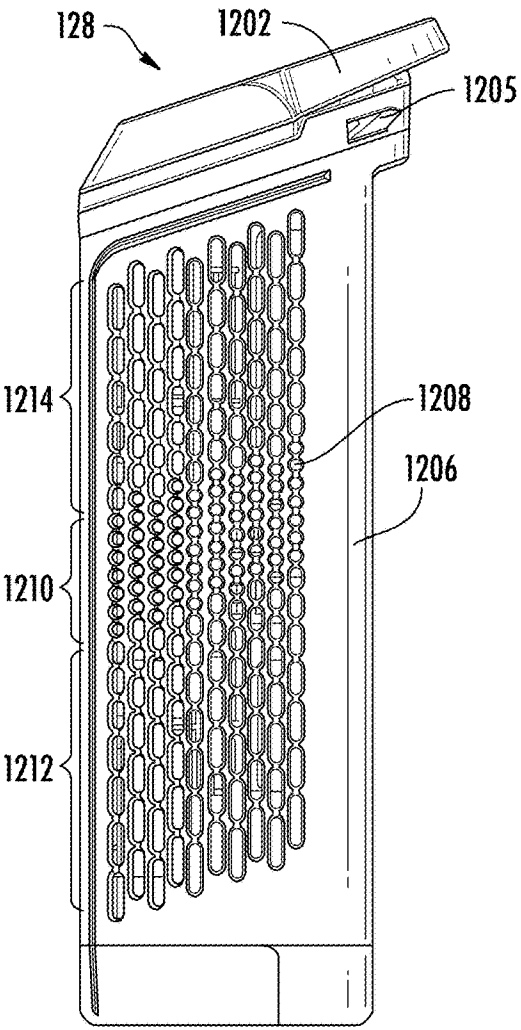
FIG. 14A is a side view of the battery pack of FIG. 12, consistent with embodiments of the present disclosure.
Figure 13:
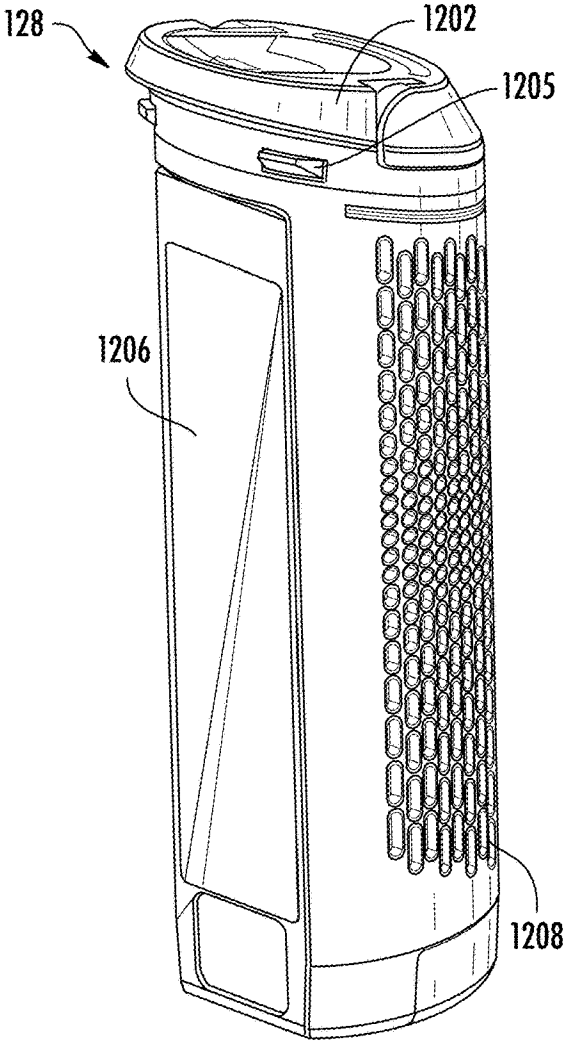
FIG. 13 is another perspective view of the battery pack of FIG. 12, consistent with embodiments of the present disclosure.
Figure 12:
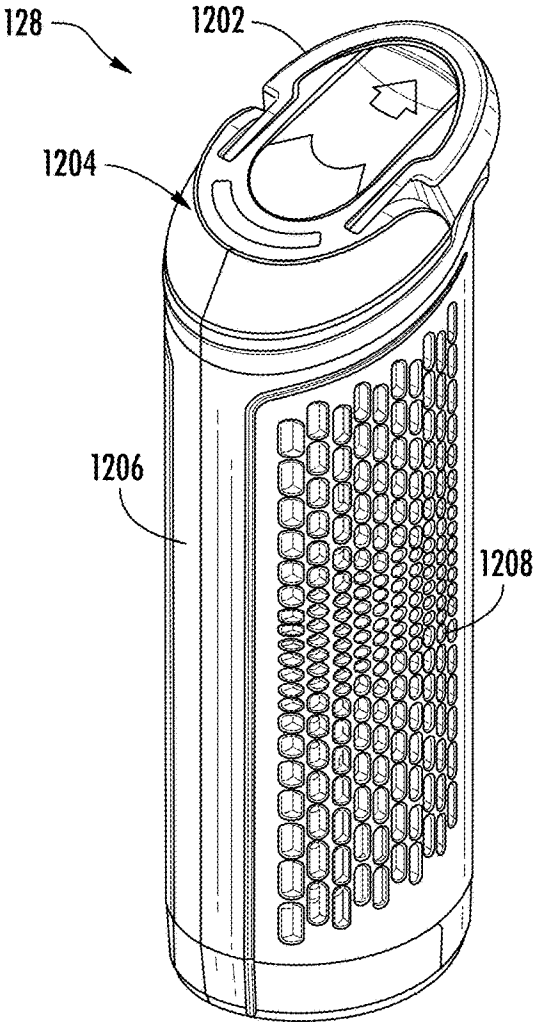
FIG. 12 is a perspective view of a battery pack configured to be inserted within the pod of FIG. 6, consistent with embodiments of the present disclosure.

FIG. 12 shows a perspective front view of the battery pack 128. FIG. 13 shows a perspective back view of the battery pack 128. FIG. 14A shows a side view of the battery pack 128. As shown, the battery pack 128 includes a battery handle 1202 configured to transition between a storage position (e.g., where the battery handle 1202 is substantially flush with a top surface 1204 of the battery pack 128) to an upright (or release) position. In some instances, and as shown, when transitioning the battery handle 1202 between the storage position and the upright position, the battery handle 1202 may actuate a battery latching mechanism 1400 (see FIG. 14B) that causes a latch 1205 to transition between a latching state and a delatching (or release) state. The latch 1205 can be configured to retain the battery pack 128 within the battery cavity 116.

Figure 14B:
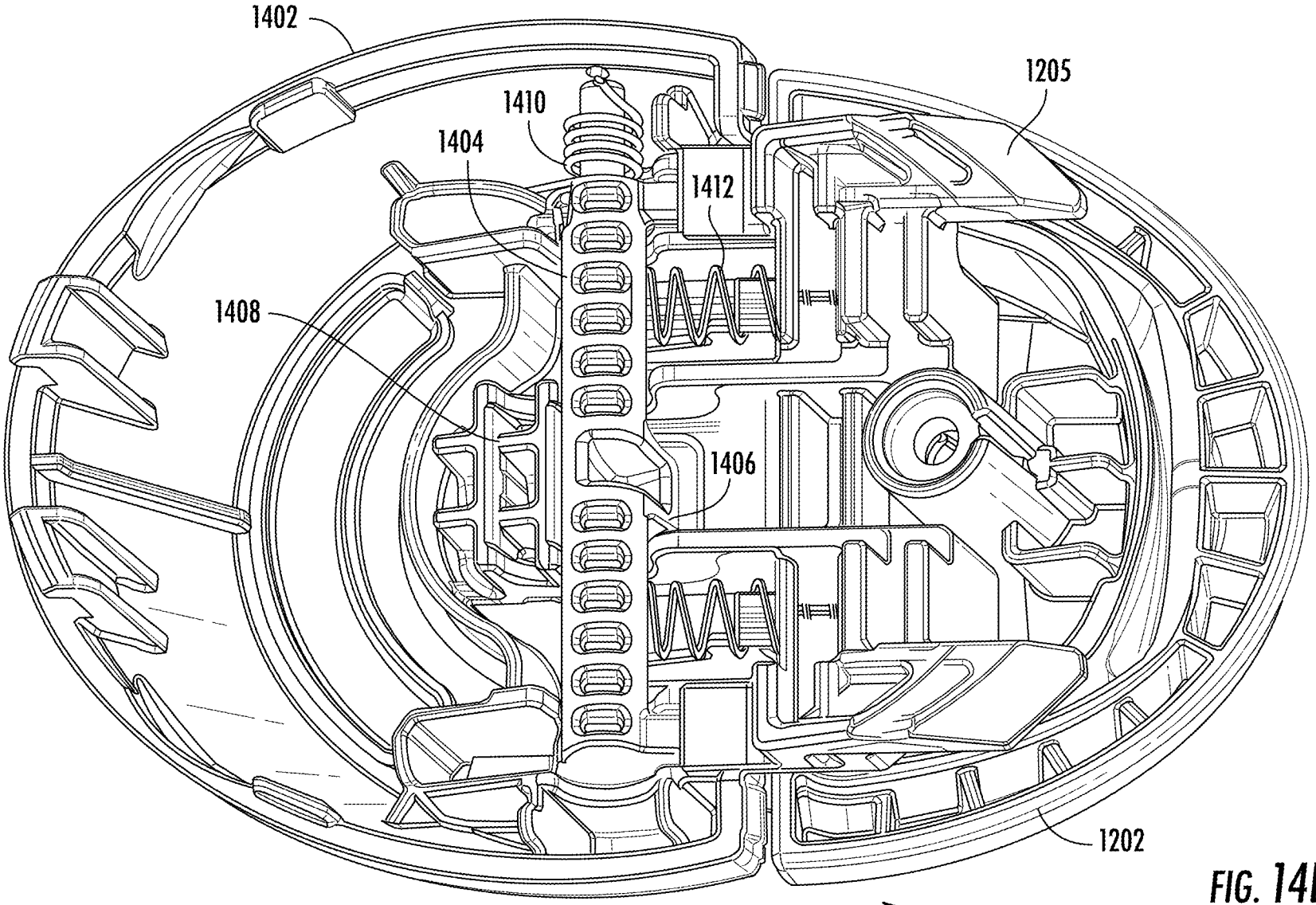
FIG. 14B shows a perspective view of a latching mechanism for the battery pack of FIG. 12, consistent with embodiments of the present disclosure.

As shown, in FIG. 14B, the battery latching mechanism 1400 includes the battery handle 1202, wherein the battery handle 1202 is pivotally coupled to a closure cap 1402 of the battery pack 128. As shown, the battery handle 1202 is pivotally coupled to the closure cap 1402 using an axle 1404 extending between opposing sides of the closure cap 1402. The axle 1404 includes a cam 1406 configured to engage a sled 1408. The sled 1408 is slideably coupled to the closure cap 1402 such that the sled 1408 slides in response to rotation of the axle 1404. The sliding movement of the sled 1408 causes the latch 1205 to transition between the latching state and the delatching state. A handle biasing mechanism 1410 (e.g., a torsion spring) may urge the battery handle 1202 towards the storage position and a latch biasing mechanism 1412 (e.g., a compression spring) may urge the latch 1205 towards the latch state. For example, the latch biasing mechanism 1412 may be configured extend between the sled 1408 and a portion of the closure cap 1402 such that the sled urges the latch 1205 towards the latch state.

Referring again to FIGS. 12, 13, and 14A, as also shown, the battery pack 128 may include a housing 1206 having a plurality of apertures 1208 extending therethrough. The apertures 1208 are configured to allow air to flow through the battery pack 128. The air passing through the battery pack can be exhaust air from the suction motor 802. Additionally, or alternatively, the battery pack 128 may include a cooling fan disposed therein for generating air flow to cool the battery pack 128.

As shown, the apertures 1208 proximate the center of the battery pack 128 have a smaller size than the apertures 1208 spaced apart from the center of the battery pack 128. As such, a size of the apertures 1208 may generally increase with increasing distance from the center of the battery pack 128. For example, in some instances, a size of the apertures 1208 may progressively increase with increasing distance from the center of the battery pack 128.

Alternatively, the apertures 1208 may be arranged according to one or more groups along the battery pack 128. Each group may have a predetermined aperture size, wherein the aperture size increases between groups with increasing distance from the center of the battery pack 128. In some instances, the aperture size may increase within a respective group with increasing distance from the center of the battery pack 128. For example, and as shown, a first (e.g., central) group 1210 may have a substantially constant aperture size therein and second and third groups 1212 and 1214 may have aperture sizes that increase with increasing distance from the first group 1210.

As also shown, the apertures 1208 proximate the center of the battery pack 128 may have a circular outline (or shape) and the apertures 1208 spaced apart from the center of the battery pack 128 may have an elongated (e.g., elliptical) outline (or shape). In other words, the apertures 1208 may include at least one aperture having a circular outline and at least one aperture having an elongated outline. In some instances, the apertures 1208 having the circular outline may correspond to the first group 1210 and the apertures 1208 having the elongated outline may correspond to the second and third groups 1212 and 1214. As such, the apertures 1208 corresponding to the first group 1210 may generally be described as having a first set of characteristics and the apertures 1208 corresponding to the second and third groups 1212 and 1214 may generally be described as having a second set of characteristics, wherein the first and second sets of characteristics are different. The characteristics can include one or more of size, shape, orientation, and/or any other characteristic.

Figure 14C:
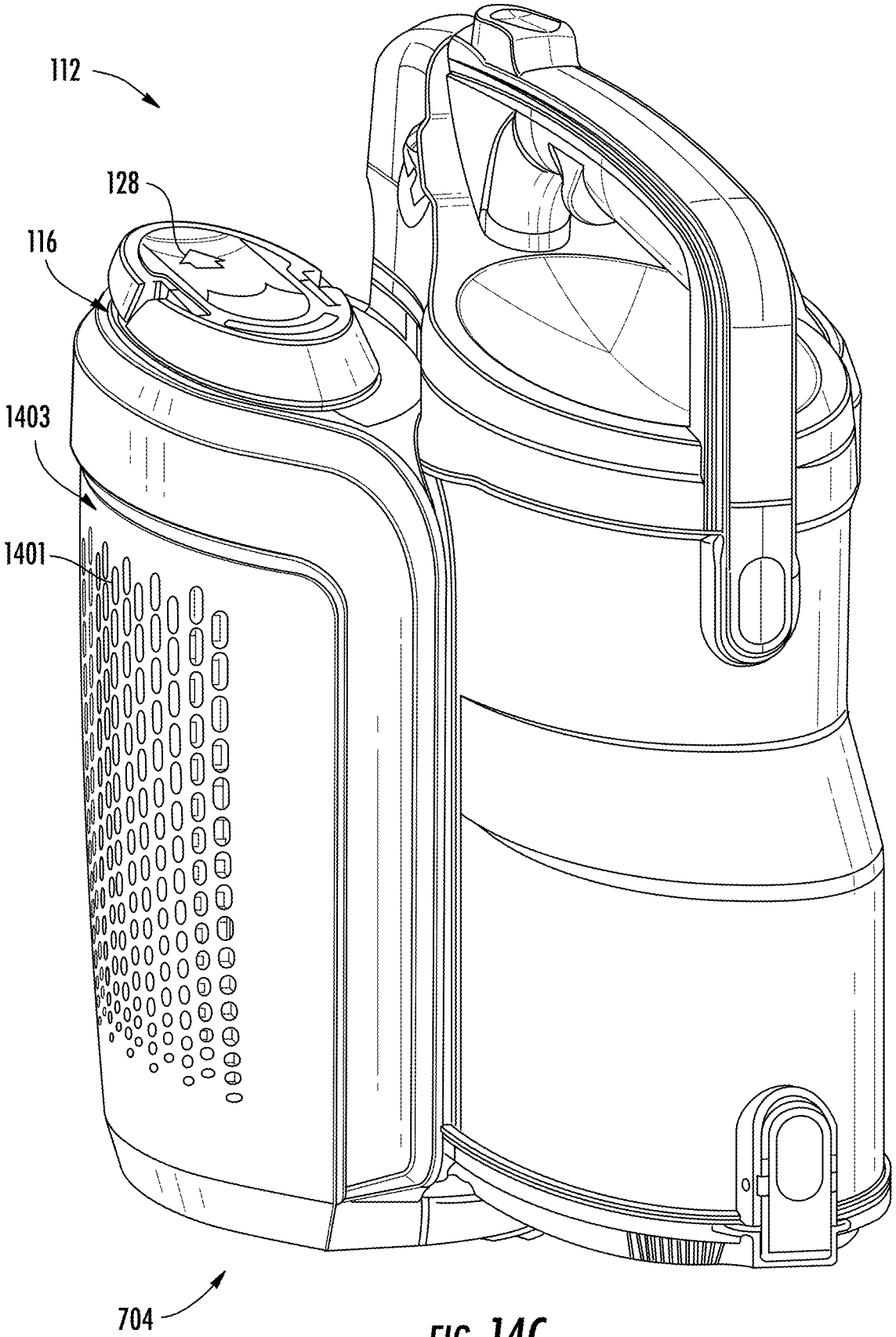
FIG. 14C is a perspective view of the pod of FIG. 6, consistent with embodiments of the present disclosure.
Figure 15:
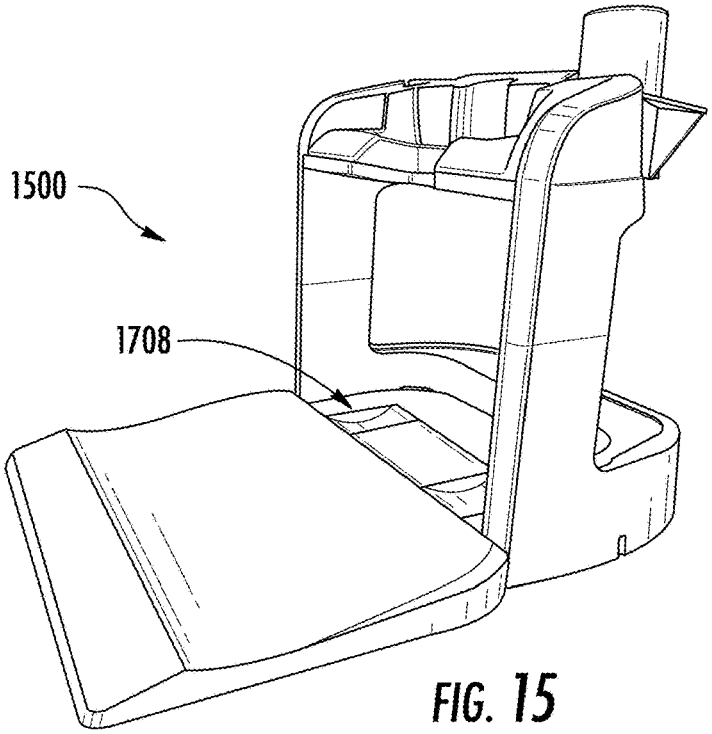
FIG. 15 is a perspective view of a dock configured to receive, for example, the pod of FIG. 6, consistent with embodiments of the present disclosure.
Figure 16:
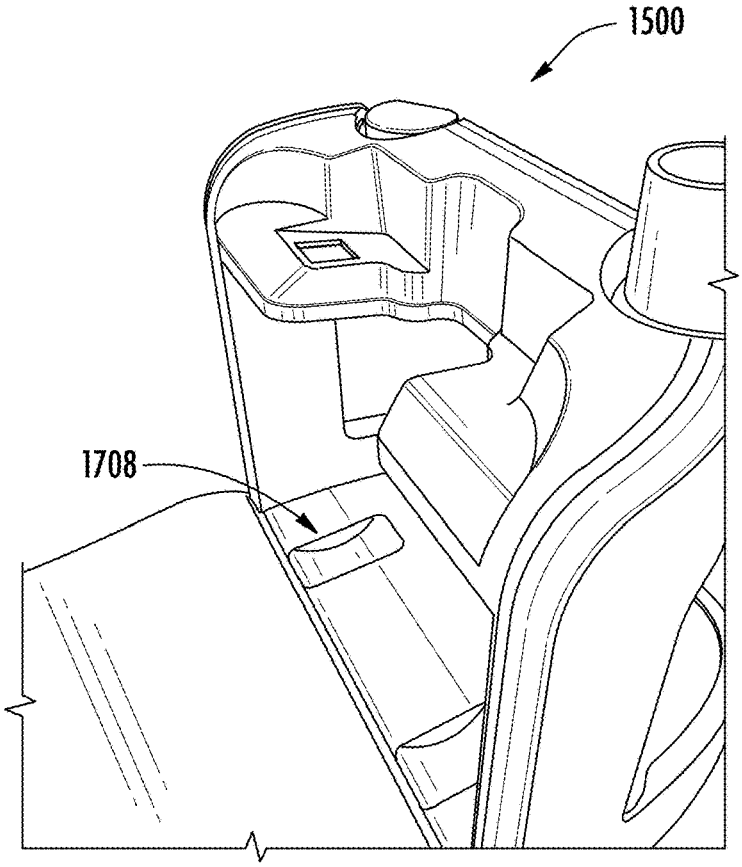
FIG. 16 is another perspective view of the dock of FIG. 15, consistent with embodiments of the present disclosure.
Figure 17A:
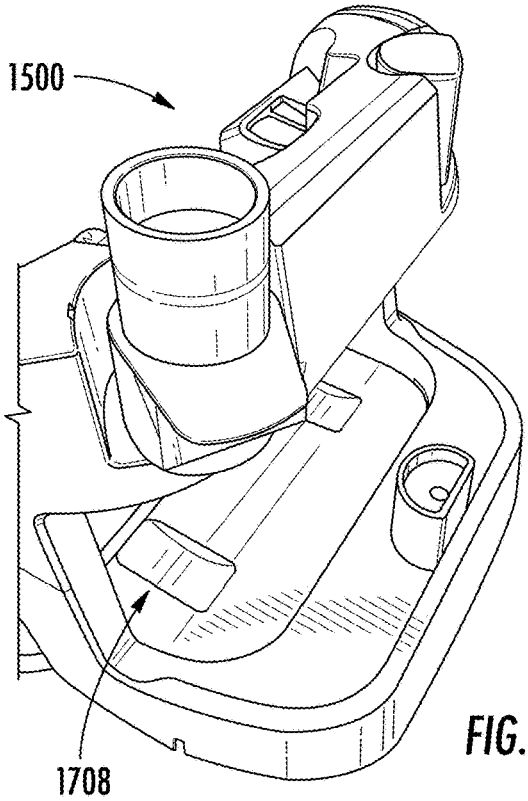
FIG. 17A is another perspective view of the dock of FIG. 15, consistent with embodiments of the present disclosure.
Figure 17B:
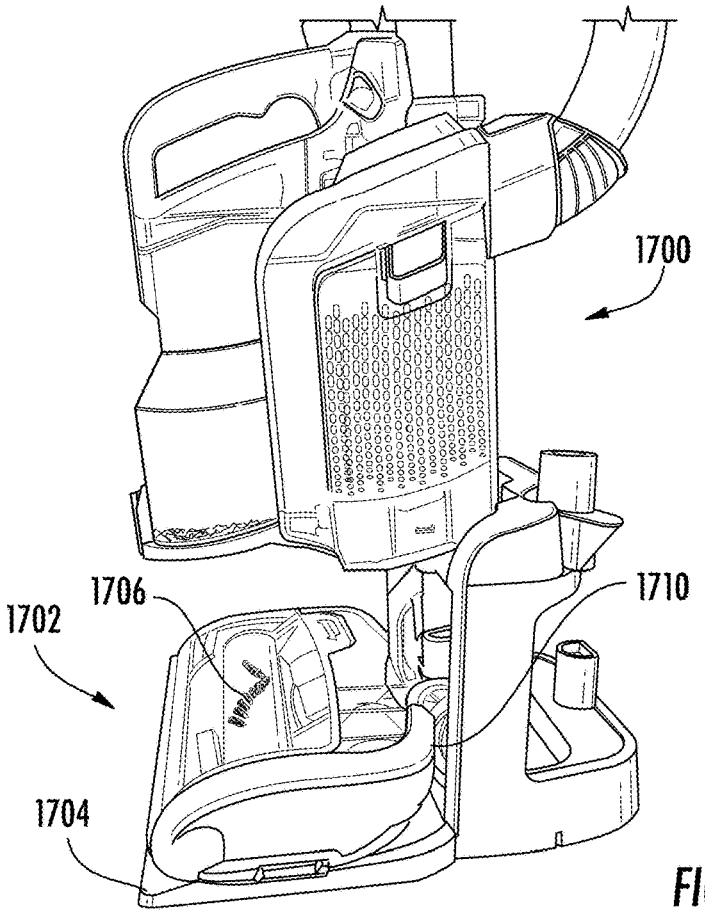
FIG. 17B is a perspective view of the dock of FIG. 15 having a pod and surface cleaning head docked thereto, consistent with embodiments of the present disclosure.

FIG. 14C shows a perspective view of the battery pack 128 installed in the pod 112. As shown, a plurality of apertures 1401 can extend from an outer surface 1403 of the pod 112 and into the battery cavity 116. The plurality of apertures 1401 allow air to flow out of the battery pack 128 and into the environment. As shown, the plurality of apertures 1401 increase in size as the apertures 1401 move away from the base portion 704 of the pod 112. In some instances, the plurality of apertures 1401 can be arranged to generally correspond to the apertures 1208 in the battery pack 128.

FIGS. 15-17A show an example of a cleaner docking station 1500. The cleaner docking station 1500 can be configured to couple to the pod 112 and/or one or more accessories. FIG. 17B shows a pod 1700, which may be an example of the pod 112, and a surface cleaning head 1702, which may be an example of the surface cleaning head 106, docked to the cleaner docking station 1500.

As shown, the cleaner docking station 1500 includes a stage 1704 upon which the surface cleaning head 1702 is positioned. In some instances, the stage 1704 is configured to electrically couple to the surface cleaning head 1702. For example, the stage 1704 may include one or more electrical charging contacts configured to engage corresponding electrical charging contacts of the surface cleaning head and/or the stage 1704 may include a wireless charging module. As such, one or more batteries powering the pod 1700 may be recharged when the surface cleaning head 1702 is positioned on the stage 1704.

The stage 1704 may also be configured to clean one or more agitators 1706 of the surface cleaning head 1702. For example, the stage 1704 may include and/or define a comb or blade configured to engage one or more of the one or more agitators 1706, wherein the comb or blade is configured to remove fibrous debris (e.g., hair or string) from the one or more agitators 1706. In some instances, the comb or blade may be stationary and remove fibrous debris in response to the agitators 1706 being rotated while the surface cleaning head 1702 is positioned on the stage 1704. In some instances, the stage 1704 may define one or more receptacles 1708 configured to receive corresponding wheels 1710 of the surface cleaning head 1702. As such, the receptacles 1708 may retain the surface cleaning head 1702 on the stage 1704.

Figure 19A:
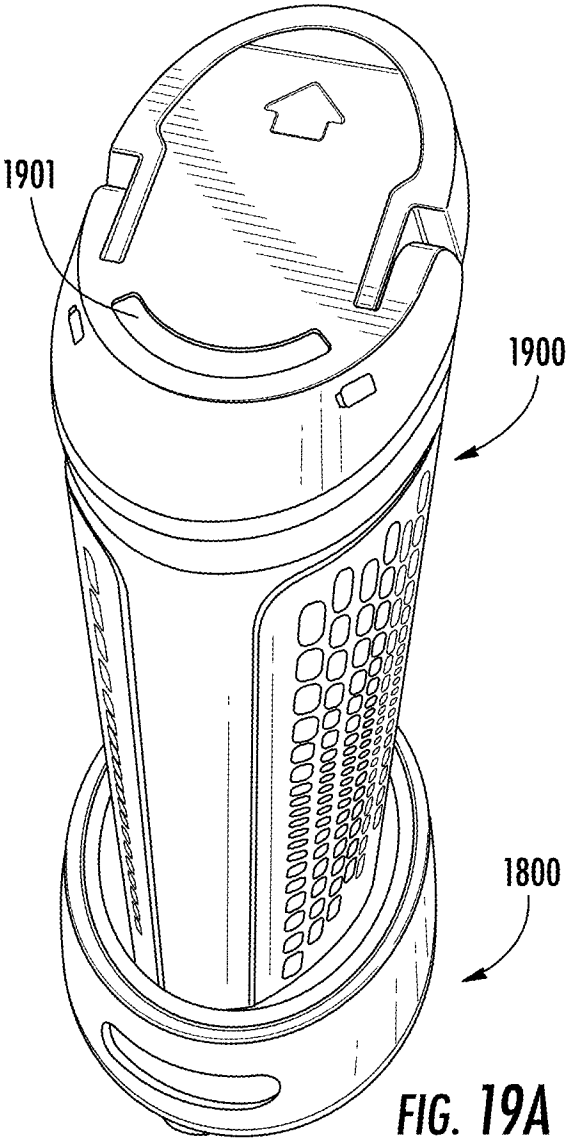
FIG. 19A is a perspective view of the battery docking station of FIG. 18 having a battery pack docked thereto, consistent with embodiments of the present disclosure.
Figure 18:
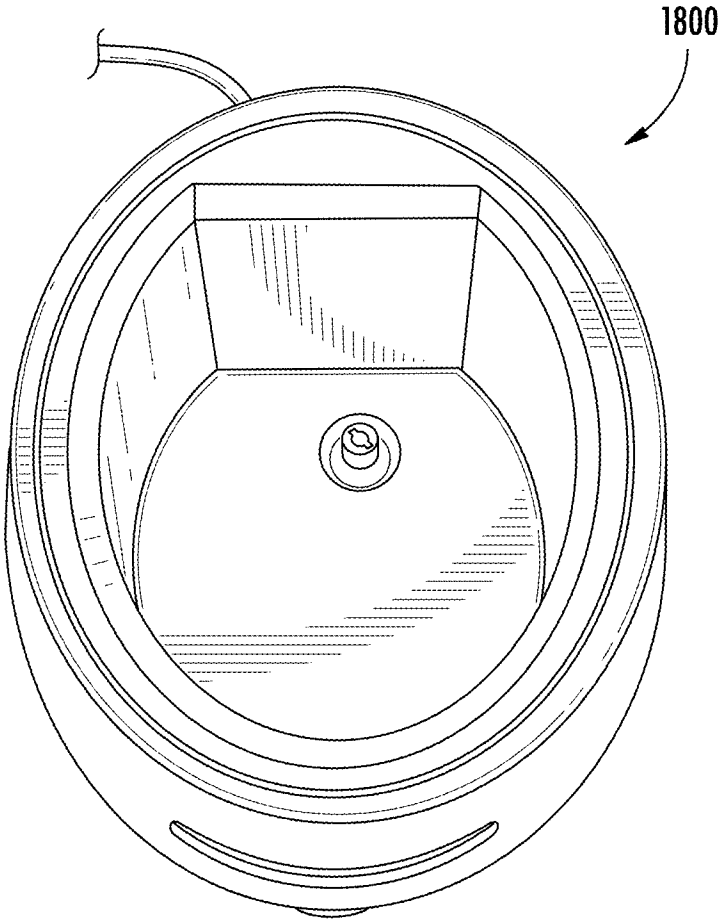
FIG. 18 is a perspective view of an example of a battery docking station, consistent with embodiments of the present disclosure.
Figure 19B:
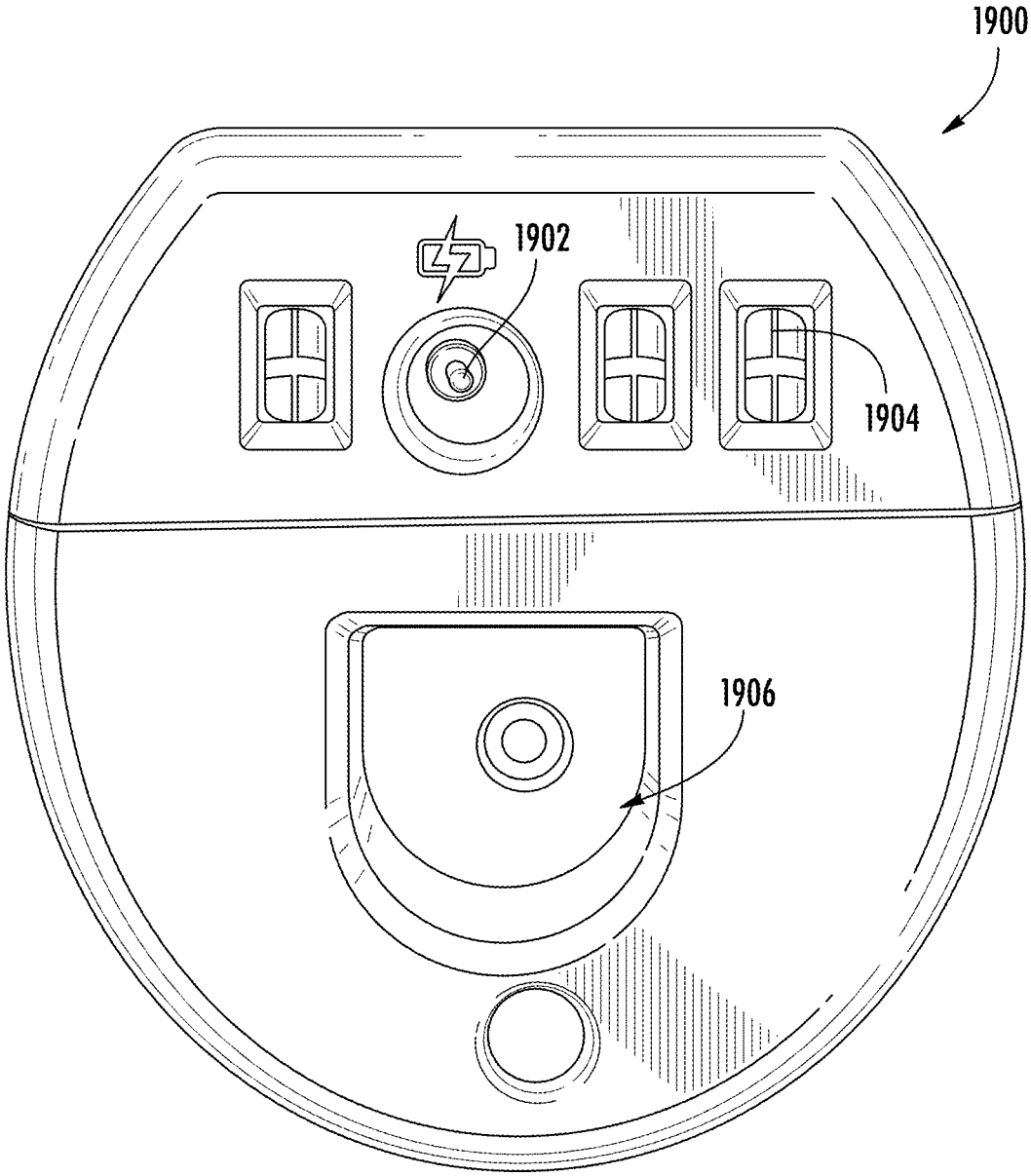
FIG. 19B is a bottom view of the battery pack of FIG. 19A, consistent with embodiments of the present disclosure.

FIG. 18 shows an example of a battery docking station 1800 configured to receive, for example, the battery pack 128. FIG. 19A shows a battery pack 1900, which may be an example of the battery pack 128, disposed within the battery docking station 1800. As shown, the battery pack 1900 may include an illuminated charge indicator 1901 that can be configured to illuminate based on a level of charge in the battery pack 1900. For example, segments of the charge indicator 1901 can be illuminated based on stored charge. FIG. 19B shows a bottom view of the battery pack 1900. As shown, the battery pack 1900 can include a charging port 1902 and electrical contacts 1904. As also shown, the battery pack 1900 includes a receptacle 1906 for receiving at least a portion of a protrusion (e.g., the battery protrusion 906) extending from a base of a battery cavity of a pod.

Figure 22:
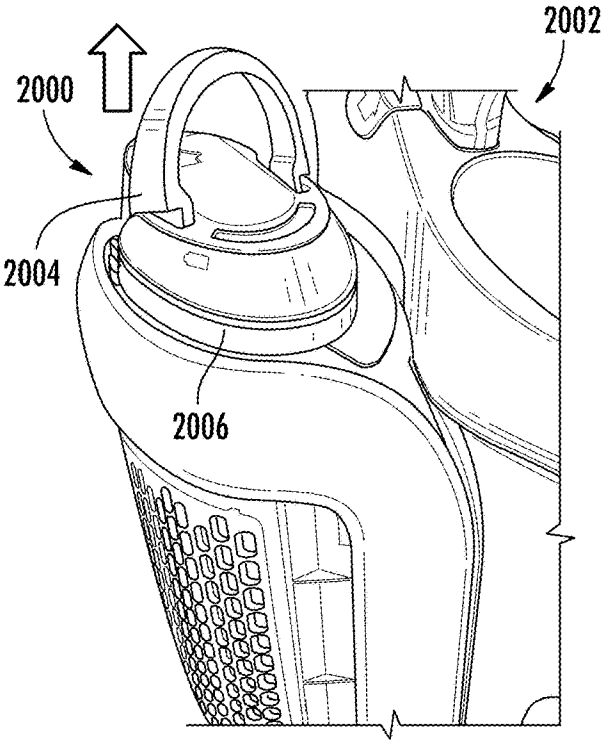
FIG. 22 is a perspective view of the pod of FIG. 21, wherein the battery pack is partially removed from the pod, consistent with embodiments of the present disclosure.
Figure 21:
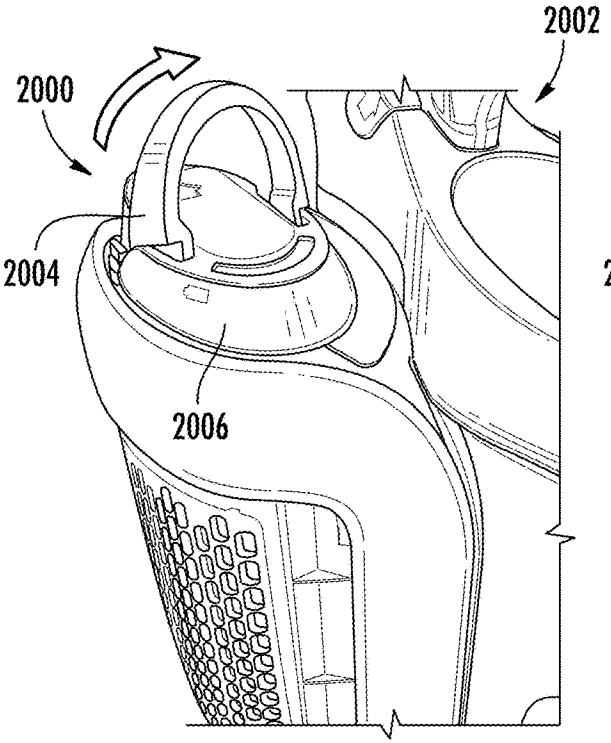
FIG. 21 is a perspective view of the pod of FIG. 20, wherein a handle of the battery pack is lifted into a removal position, consistent with embodiments of the present disclosure.
Figure 20:
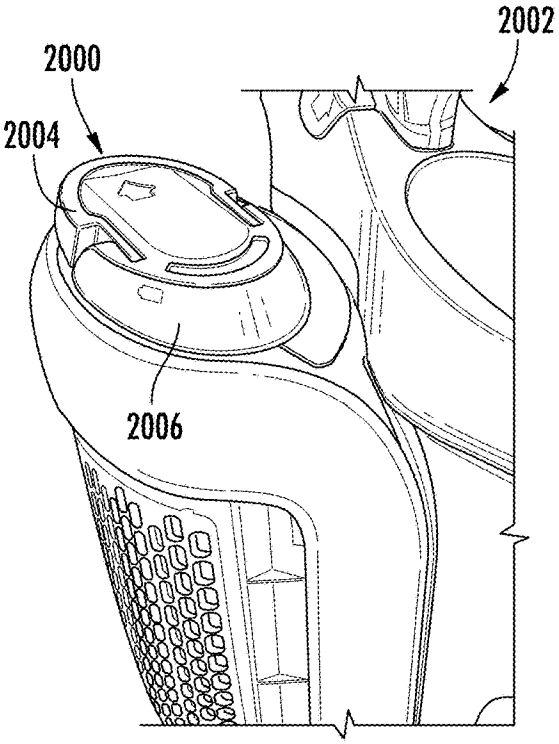
FIG. 20 is a perspective view of an example of a portion of a pod having a battery pack, consistent with embodiments of the present disclosure.

FIGS. 20-22 show an example of a battery pack 2000, which may be an example of the battery pack 128, being removed from a pod 2002, which may be an example of the pod 112. The battery pack 2000 may be releasably coupled to the pod 2002 using, for example, an actuatable latch. As shown, the battery pack 2000 includes a battery handle 2004. The battery handle 2004 can be pivotally coupled to a housing 2006 of the battery pack 2000. For example, the battery handle 2004 can be configured to be pivoted between a storage and an upright (or removal) position. As the battery handle 2004 is pivoted, the battery handle 2004 may cause an actuatable latch coupling the battery pack 2000 to the pod 2002 to be actuated towards a release position. Once in the release position a force can be exerted on the battery handle 2004 to remove the battery pack 2000 from the pod 2002. In other words, the battery pack 2000 can be configured to be decoupled from the pod 2002 in response to a pivoting of the battery handle 2004 from a storage position towards an upright (or removal position).

A reconfigurable surface treatment apparatus, consistent with the present disclosure, may include a wand and a pod removably coupled to the wand. The wand may have a first distal end that is configured to couple to a surface cleaning head and a second distal end that is configured to couple to a handle. The pod may include a suction motor assembly cavity, a battery cavity, and a dust cup cavity. The suction motor assembly cavity and the battery cavity may be disposed on opposing sides of a vertical plane, wherein the vertical plane extends along a central longitudinal axis of the pod. The dust cup cavity may be disposed between the suction motor assembly cavity and the battery cavity such that at least a portion of the dust cup cavity is disposed on each side of the vertical plane.

In some instances, the battery cavity may be fluidly coupled to the suction motor assembly cavity when a dust cup is received in the dust cup cavity. In some instances, the battery cavity may be further configured to receive a filter. In some instances, the battery cavity may further comprise a battery protrusion configured to transition between a depressible state and a rigid state in response to the battery cavity receiving the filter. In some instances, the battery protrusion may be further configured to be depressed when a battery pack and the filter are disposed within the battery cavity. In some instances, the reconfigurable surface treatment apparatus may further include a flexible conduit configured to fluidly couple the pod to the wand, the flexible conduit being electrified. In some instances, the reconfigurable surface treatment apparatus may further include the handle, wherein the handle may include a toggle configured to decouple the handle from the wand. In some instances, the wand may include a detachable portion and a neck, the detachable portion being configured to be separable from the neck. In some instances, the detachable portion may be separable from the neck in response to actuation of a release toggle. In some instances, the reconfigurable surface treatment apparatus may further include a battery pack disposed within the battery cavity. In some instances, the battery pack may include a housing having a plurality of apertures configured to allow air to pass therethrough. In some instances, at least one of the plurality of apertures may have a circular shape and at least one of the plurality of apertures may have an elongated shape.

A pod for a reconfigurable surface treatment apparatus, consistent with the present disclosure, may include a suction motor assembly cavity, a battery cavity, and a dust cup cavity. The suction motor assembly cavity and the battery cavity may be disposed on opposing sides of a vertical plane, wherein the vertical plane extends along a central longitudinal axis of the pod. The dust cup cavity may be disposed between the suction motor assembly cavity and the battery cavity such that at least a portion of the dust cup cavity is disposed on each side of the vertical plane.

In some instances, the battery cavity may be fluidly coupled to the suction motor assembly cavity when a dust cup is received in the dust cup cavity. In some instances, the battery cavity may be further configured to receive a filter. In some instances, the battery cavity may further comprise a battery protrusion configured to transition between a depressible state and a rigid state in response to the battery cavity receiving the filter. In some instances, the battery protrusion may be further configured to be depressed when a battery pack and the filter are disposed within the battery cavity. In some instances, the pod may further include a battery pack disposed within the battery cavity. In some instances, the battery pack may include a housing having a plurality of apertures configured to allow air to pass therethrough. In some instances, at least one of the plurality of apertures may have a circular shape and at least one of the plurality of apertures may have an elongated shape.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A battery pack for a vacuum cleaner comprising:
- a housing;
- a plurality of apertures extending through the housing, the plurality of apertures being configured to allow air to flow through the battery pack;
- a handle pivotally coupled to the housing, the handle being configured to transition between a storage position and an upright position; and
- a battery latch configured to transition between a latching state and a release state in response to pivotal movement of the handle between the storage position and the upright position, wherein the battery latch is configured to removably couple the battery pack to the vacuum cleaner.

2. The battery pack of claim 1, wherein the battery latch is in the release state when the handle is in the upright position and the battery latch is in the latching state when the handle is in the storage position.

3. The battery pack of claim 1 further comprising a closure cap coupled to an end of the housing and forming at least a portion of a top surface of the battery pack.

4. The battery pack of claim 3, wherein the handle is pivotally coupled to the closure cap using an axle.

5. The battery pack of claim 4, wherein the axle includes a cam and rotational movement of the cam is configured to cause the battery latch to transition between the latching state and the release state.

6. The battery pack of claim 1, wherein the handle is biased towards the storage position.

7. The battery pack of claim 1, wherein the battery latch is biased towards the latching state.

8. The battery pack of claim 1, wherein the plurality of apertures include a first aperture of a first size and a second aperture of a second size, the second size being greater than the first size.

9. The battery pack of claim 8, wherein the first aperture is closer to a longitudinal center of the housing than the second aperture.

10. The battery pack of claim 9, wherein the first aperture has a circular shape and the second aperture has an elongated shape.

11. A surface treatment apparatus comprising:
- a dust cup;
- a battery cavity; and
- a battery pack configured to be removably received within the battery cavity, the battery pack including:
  - a housing;
  - a plurality of apertures extending through the housing, the plurality of apertures being configured to allow air to flow through the battery pack;
- a handle pivotally coupled to the housing, the handle being configured to transition between a storage position and an upright position; and
- a battery latch configured to transition between a latching state and a release state in response to pivotal movement of the handle between the storage position and the upright position, wherein the battery latch is configured to removably couple the battery pack within the battery cavity.

12. The surface treatment apparatus of claim 11, wherein the battery latch is in the release state when the handle is in the upright position and the battery latch is in the latching state when the handle is in the storage position.

13. The surface treatment apparatus of claim 11 further comprising a closure cap coupled to an end of the housing and forming at least a portion of a top surface of the battery pack.

14. The surface treatment apparatus of claim 13, wherein the handle is pivotally coupled to the closure cap using an axle.

15. The surface treatment apparatus of claim 14, wherein the axle includes a cam and rotational movement of the cam is configured to cause the battery latch to transition between the latching state and the release state.

16. The surface treatment apparatus of claim 11, wherein the handle is biased towards the storage position.

17. The surface treatment apparatus of claim 11, wherein the battery latch is biased towards the latching state.

18. The surface treatment apparatus of claim 11, wherein the plurality of apertures include a first aperture of a first size and a second aperture of a second size, the second size being greater than the first size.

19. The surface treatment apparatus of claim 18, wherein the first aperture is closer to a longitudinal center of the housing than the second aperture.

20. The surface treatment apparatus of claim 19, wherein the first aperture has a circular shape and the second aperture has an elongated shape.

* * * * *